United States Patent [19]

Clark et al.

[11] Patent Number: 4,504,568

[45] Date of Patent: Mar. 12, 1985

[54] SENSITIVE SILVER HALIDE PHOTOTHERMOGRAPHIC MATERIALS FOR PRODUCING DYE IMAGES

[75] Inventors: Bernard A. Clark, Maidenhead; Michael J. Simons, Ruislip; Colin Holstead, Watford, all of England

[73] Assignee: Eastman Kodak Company, Rochester, N.Y.

[21] Appl. No.: 576,503

[22] Filed: Feb. 2, 1984

[30] Foreign Application Priority Data

Feb. 8, 1983 [GB] United Kingdom ..... 8303472

[51] Int. Cl.[1] ..... G03C 1/40; G03C 5/54; G03C 5/26

[52] U.S. Cl. ..... 430/203; 430/226; 430/351; 430/553; 430/555; 430/557; 430/558; 430/559

[58] Field of Search ..... 430/203, 222, 226, 351, 430/553, 555, 557, 558 A, 559

[56] References Cited

U.S. PATENT DOCUMENTS

| | | | |
|---|---|---|---|
| 3,227,550 | 1/1966 | Whitmore et al. | 430/226 |
| 3,457,075 | 7/1969 | Morgan et al. | 430/351 |
| 3,531,286 | 9/1970 | Renfrew | 430/351 |
| 3,761,270 | 9/1973 | de Mauriac et al. | 430/203 |
| 4,021,240 | 5/1977 | Cerquone et al. | 430/203 |
| 4,430,415 | 2/1984 | Aono et al. | 430/203 |

FOREIGN PATENT DOCUMENTS

| | | |
|---|---|---|
| 1207785 | 10/1970 | United Kingdom . |
| 1400244 | 7/1975 | United Kingdom . |
| 2056103A | 3/1981 | United Kingdom . |

OTHER PUBLICATIONS

*Research Disclosure,* Jun. 1978, Item No. 17029.

*Research Disclosure,* May 1978, Item No. 16966.

*Research Disclosure,* Dec. 1978, Item No. 17643.

*Research Disclosure,* Jan. 1983, Item No. 22534.

*Modern Photographic Processing,* by Grant Haist, Wiley, N.Y., (1979), vol. 2, Chapter 9, pp. 478–495.

*Primary Examiner*—Richard L. Schilling

*Attorney, Agent, or Firm*—Richard E. Knapp

[57] ABSTRACT

A dye-forming photothermographic element comprises in a binder, in reactive association, (a) photographic silver halide, (b) an image forming combination comprising (i) a reducible organic silver salt with (ii) a reducing agent selected from the group consisting of p-phenylenediamine, p-aminophenol, sulfonamidophenol, sulfonamidoaniline and hydrazone developing agents, and (c) a coupler which is capable of forming an image dye by reaction with the oxidized form of the reducing agent.

In such a photothermographic element improvements are provided wherein the coupler has attached to the carbon atom at the coupling position either (A) a group —S—Dye, wherein Dye represents an image dye, or a blocked or shifted form thereof, and any necessary linking group, or (B) a moiety —S—Z, wherein Z represents atoms linking the sulfur atom to another position in the coupler. The exposed dye-forming photothermographic element is capable of forming a dye image by merely heating the element. The dye-forming photothermographic element can be a diffusion transfer photothermographic element in which the image dye formed upon heating the exposed element is capable of being transferred to an image receiver.

14 Claims, No Drawings

SENSITIVE SILVER HALIDE PHOTOTHERMOGRAPHIC MATERIALS FOR PRODUCING DYE IMAGES

BACKGROUND OF THE INVENTION

1. Field of the Invention

This invention relates to a sensitive silver halide photothermographic material for producing dye images.

2. Description of the State of the Art

A sensitive photothermographic material is a photographic material with which a visible image is produced by a method comprising two main steps (i) imagewise exposure of the material to actinic radiation (usually light) so as to form a latent image therein; and (ii) overall heating of the material to form an imagewise distribution of either the desired image substance or one or more compounds which readily provide that substance. Additional steps may be needed. For example, it may be necessary to transfer the image substance, or the compound or compounds to be used in providing that substance, to another layer.

A well known type of photothermographic material contains a photographic silver halide, which gives silver latent image specks on exposure, and an oxidation-reduction image-forming combination comprising a reducible organic silver salt and an organic reducing agent therefor. The latent image specks catalyze the reaction of the organic silver salt with the reducing agent to give visible image silver. For the overall heating step (ii) a temperature is chosen at which this reaction occurs at a convenient rate in the latent image areas but at a negligible rate in the background areas. Silver halide photothermographic materials of this kind are classified as System B by Carpeneter and Lauf, in Research Disclosure June 1978, page 9, Item No. 17029.

Various System B materials have been proposed which give an image of both dye and silver. In some of these materials, the dye is generated imagewise by reaction between a coupler, incorporated in the material and the oxidation product of the organic reducing agent (see, for instance, U.K. Patent Specification No. 1,400,244). In another proposed material, the dye is part of the reducible organic silver salt, and is rendered diffusible when that salt is reduced (see Research Disclosure May 1978, Item No. 16966). If it is necessary, or desirable, to separate the dye image from the silver image, one method which can be adopted is to transfer the dye image by diffusion to a receiving layer which contains a mordant for the dye. Diffusion transfer can be enabled, or assisted, by use of an elevated temperature and/or a solvent.

In any process involving a diffusion transfer step, particularly one carried out at an elevated temperature, it is very desirable for there to be a considerable difference between the diffusibility of the substance being transferred and that of the substance responsible for its generation or release. If the difference is inadequate, diffusion of reactants can occur in non-image areas leading to unwanted background density.

SUMMARY OF THE INVENTION

We have discovered a dye-forming photothermographic material of the System B type in which, during heat-processing, a coupling reaction gives an immobile product by using as a coupler a compound having a sulfur atom bonded to the carbon atom at the coupling position and also to the moiety which is to be immobilized. When the coupling reaction occurs, the sulfur atom is released from the coupling position and immediately reacts with silver ion from the organic silver salt or silver halide to give a highly insoluble and immobile silver salt of the attached moiety.

According to the present invention there is provided a dye-forming photothermographic element which comprises a support bearing in a binder, in reactive association, (a) photographic silver halide;

(b) an image-forming combination comprising (i) a reducible organic silver salt and (ii) a reducing agent selected from the group consisting of p-phenylenediamine, p-aminophenol, sulfonamidophenol, sulfonamidoaniline and hydrazone developing agents, and (c) a coupler which is capable of reacting with the oxidized form of the reducing agent to form a dye, wherein the coupler has attached to the carbon atom at the coupling position either (A) a group —S—Dye, wherein Dye represents an image dye, or a blocked or shifted form thereof, and any necessary linking group or (B) a moiety —S—Z—, wherein —Z— represents atoms linking the sulfur atom to another position in the coupler, in which latter case the coupler may optionally include a group Dye as already defined.

A dye-forming photothermographic element of the invention can be designed for a variety of processes. If the coupler (c) has a group —S—Dye attached to the coupling position, it may be represented by the general formula:

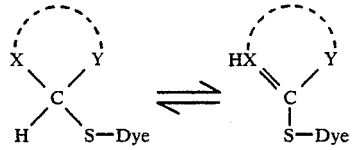

(I)

wherein X and Y are moieties which confer coupling activity on the carbon atom shown and which, as indicated by the broken line, may be separate or linked. As stated above, the group —S—Dye may contain a linking group. Whether or not it does so depends upon the synthetic procedure chosen for introducing the dye moiety into the molecule. The moieties X and Y contain electron-withdrawing groups which, if not directly attached to the carbon atom at the coupling position are connected therewith by links, such as methine chains, capable of transmitting the electron-withdrawing effect. Couplers of Formula I can be made which are derivatives of a great variety of couplers of the formula:

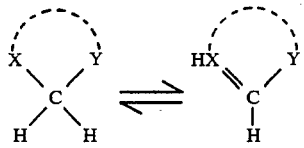

(Ia)

including phenols, naphthols, open-chain active methylene couplers and pyrazolones. In the Formulae I and Ia above, one or other of the tautomeric structures may predominate. As will be evident from the structures of particular couplers hereinafter described, the hydrogen atom which migrates from the coupling position, can migrate to any appropriate atom of X.

When a photothermographic element of the invention containing a coupler of Formula I is imagewise exposed and heat-processed, the group —S—Dye is immobilized in the regions where development occurs. Thus for the usual case wherein negative-working photographic silver halide (a) is present, a dye distrubution corresponding to a negative image is immobilized and a dye distribution corresponding to a positive image remains mobile in the developed layer. This mobile unreacted dye coupler can be transfered by diffusion to a receiver layer as described hereinafter.

If, as preferred, the coupler (c) has a moiety —S—Z— attached, by means of the sulfur atom, to the carbon atom at the coupling position, it may be represented by the formula:

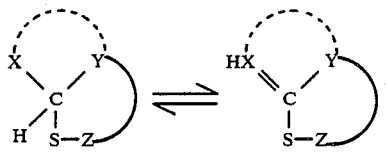

(II)

where X and Y are as defined for Formula I and Z is any link which results in the reaction product of the coupler and oxidized developing agent being immobilized by silver salt formation. The link Z may complete a variety of heterocyclic systems, including those with fused rings, and these may be substituted with a variety of substituents, including halogen atoms and alkyl such as methyl, ethyl, propyl and butyl; alkoxy such as methoxy and ethoxy; and aryl groups, such as phenyl, which groups may themselves be substituted. If desired, one or more 'Dye' groups may be attached to the coupler at any convenient site or sites in the moieties X, Y and Z.

If the coupler (c) in a photothermographic material of the invention is of Formula II and does not contain one or more 'Dye' groups, processing of the exposed material forms a negative image of an immobile dye. Taking, for example, the case where the developing agent is a p-phenylenediamine (each of $R^1$ and $R^2$ being hydrogen or one of the substituents known to be useful on such color developing agents and $R^3$ representing the possible presence of one or more substituents), the coupling reaction may be represented as follows:

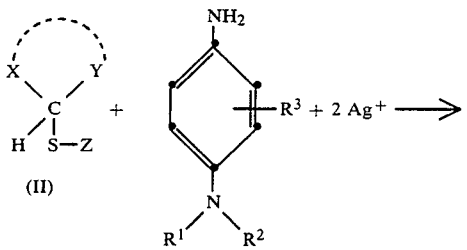

-continued

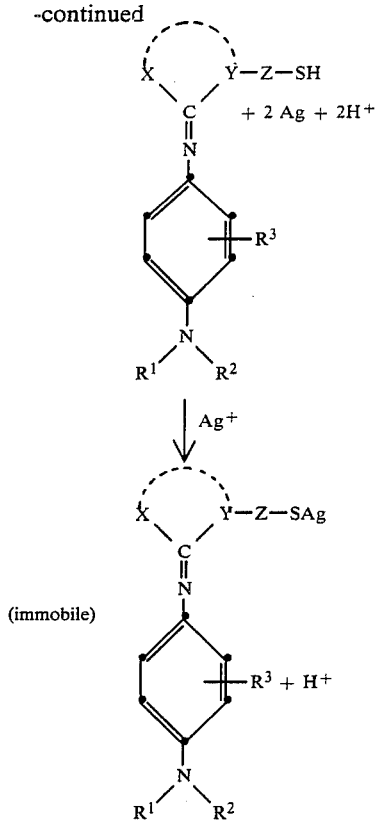

(immobile)

Detailed Description of the Invention

The photographic silver halide can be any of those employed in sensitive photographic materials and can be prepared in any desired manner. If, as is preferred, the binder in the layer or layers present is hydrophilic, the silver halide is preferably a conventional gelatino-silver halide emulsion. To obtain high sensitivity the halide preferably is, or comprises at least 50 mole percent of, bromide and is chemically sensitized. It may be spectrally sensitized. References to patents and other technical literature describing methods of preparing photographic emulsions are given in Research Disclosure, Vol. 176, December 1978, Item 17643 (published by Kenneth Mason Publications Limited; Emsworth; Hampshire P010 7DD; United Kingdom). The sensitive silver halide can be a tabular grain photographic silver halide, such as described in Research Disclosure, Vol. 225, January 1983, Item 22534.

The reducible organic silver salt forms part of an oxidation-reduction image-forming combination and may be almost any of those known for the purpose. References to various salts and to methods for their preparation are given in Research Disclosure, Vol. 170, June 1978, Item 17029 Section II. In a preferred photothermographic material having a hydrophilic colloid binder, silver benzotriazole or silver triazole is very satisfactory with a p-phenylenediamine developer. If a hydrophobic binder is used, silver behenate may be used with a p-sulfonamidophenol or p-sulfonamidoaniline. Other useful silver salts are those of tetrazole, imidazoles, indazoles and benzimidazoles.

The developing agent has to provide an oxidation product which couples with the coupler (c) to release the sulfur atom of the coupling position, and is a member of one of five classes.

(1) p-Phenylenediamines.

These compounds are well-known for use in conventional, wet, color processing. See, for example, Modern Photographic Processing, Grant Haist, Wiley, New York (1979) Vol. 2, pp 463–8. They have been proposed for use in silver halide-containing photothermographic materials containing couplers, their oxidaion products reacting with the couplers to give image dyes—see, for instance, United Kingdom patent specification No. 1,207,785. Examples of p-phenylenediamine developing agents are:

N,N-dimethyl-p-phenylenediamine
N,N-diethyl-p-phenylenediamine
N-ethyl-N-propyl-p-phenylenediamine
N-ethyl-N-(β-hydroxyethyl)-p-phenylenediamine
4-amino-N-ethyl-N-[β-methanesulfonamidoethyl]-m-toluidine.

(2) p-Aminophenols.

The use of p-aminophenol reducing agents in color silver halide photothermographic materials containing silver benzotriazole, as the light-insensitive organic silver salt, a color coupler, and a base release agent has been suggested in United Kingdom patent specification No. 1,400,244. Examples of p-aminophenol reducing agents are:

4-amino-2-methylphenol sulfate
4-amino-2,6-dichlorophenol
4-amino-2,6-dibromophenol
4-amino-2,6-diiodophenol.

(3) p-Sulfonamidophenols.

Various sulfonamidophenols have been proposed for incorporation in photothermographic materials—see United Kingdom patent specification No. 1,433,055 and Research Disclosure, Vol. 105, January 1973, Item 10503. p-Sulfonamidophenols have been suggested for use in photothermographic materials giving color images, the materials containing, in addition to a silver halide and a reducible silver salt, a two-equivalent color coupler and an aliphatic primary amine (see Research Disclosure, Vol. 151, November 1976, Item 15108). 2,6-Dihalosulfonamidophenols have been suggested for use in color photothermographic materials containing four-equivalent couplers in Research Disclosure, Vol. 151, November 1976, Item 15127 and U.S. Pat. No. 4,021,240.

Examples of sulfonamidophenol developing agents are:

p-benzenesulfonamidophenol
2,6-dichloro-4-benzenesulfonamidophenol
4-benzenesulfonamidonaphth-1-ol
4-methanesulfonamidophenol.

(4) p-Sulfonamidoanilines.

Research Disclosure Item 15108, referred to in connection with sulfonamidophenol reducing agents, also suggests the use of sulfonamidoaniline reducing agents with two-equivalent couplers. An example of a p-sulfonamidoaniline is:

4-methanesulfonamido-N,N-dimethylaniline.

(5) Hydrazones.

Hydrazone reducing agents have been described for incorporation in photothermographic materials also containing a photographic silver halide and a dye-forming coupler, and possibly containing an organic silver salt, in United Kingdom patent specification No. 2,056,103A. The oxidized reducing agent reacts with the coupler to give an azo dye.

Examples of hydrazone reducing agents are:

3-methylbenzothiazolin-2-one hydrazone hydrochloride
3-methylbenzothiazolin-2-one benzenesulfonylhydrazone
3-methylbenzothiazolin-2-one butanesulfonylhydrazone A coupler (c) used in a photothermographic material of the invention may be a dye-coupler of the Formula I:

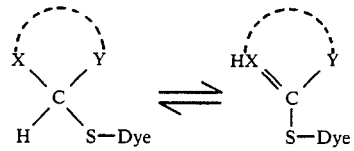

(I)

or a coupler or a dye-coupler of Formula II:

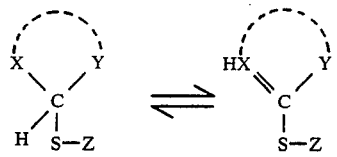

(II)

where X, Y, Z and Dye are as already defined.

The couplers of these formulae may be considered as being derived from conventional couplers by replacement of a hydrogen atom at the coupling position with the group —S—Dye or moiety —S—Z—. The principal classes of conventional coupler are outlined in, for example, Modern Photographic Processing, Grant Haist, Wiley, N.Y. (1979), Vol. 2, Chapter 9, pp 478–494. The 'Dye' moiety can be derived from any convenient image dye. Azo dyes are particularly suitable, being stable under the conditions of heat-processing and being available in a wide range of hues.

Cyan dyes are commonly produced using phenolic or naphtholic couplers. U.S. Patents describing cyan couplers include the following:

| | |
|---|---|
| 2,367,531 | 3,034,892 |
| 2,434,730 | 3,311,476 |
| 2,474,293 | 3,419,390 |
| 2,772,162 | 3,458,315 |
| 2,895,826 | 3,476,563 |

Magenta dyes are commonly produced with pyrazolone couplers; but, open chain compounds such as cyanoacetylureas have also been proposed. U.S. Patents describing magenta couplers include the following:

| | |
|---|---|
| 2,343,703 | 3,062,653 |
| 2,369,489 | 3,127,269 |
| 2,600,788 | 3,311,476 |
| 2,908,573 | 3,419,391 |
| 2,933,391 | 3,518,429 |

Yellow dyes are commonly produced with open-chain active methylene compounds such as benzoylacetanilides. Yellow dye-forming couplers are described in numerous U.S. Patents, including the following:

| | |
|---|---|
| 2,298,443 | 3,277,155 |
| 2,407,210 | 3,408,198 |

-continued

| | |
|---|---|
| 2,875,057 | 3,415,652 |
| 2,908,573 | 3,447,928 |
| 3,265,506 | 3,933,501 |

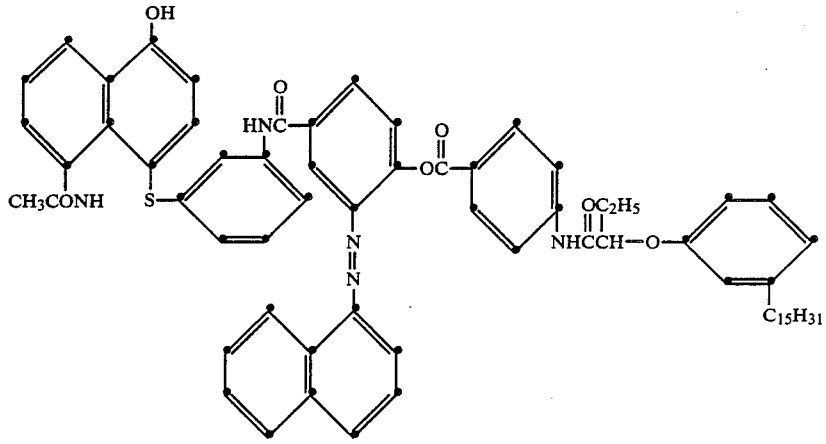

Coupler No. 1

Examples of classes of dye-couplers of Formula I and couplers and dye couplers of Formula II are considered in turn below. The majority are pyrazolones because those have been found to have excellent coupling reactivity in photothermographic systems. In the classes considered, all the 'Dye' moieties are derived from azo dyes, being selected for their hue and light-stability. Some of the dyes are metallizable, complexing with nickel or copper ions, for instance, to give products of even greater light-stability.

(1) Phenolic and naphtholic dye-couplers of formula I

Phenolic and naphtholic dye-couplers of the general Formula I which are suitable for use in the present invention can be represented by the formulae:

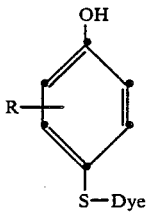

(III)

and

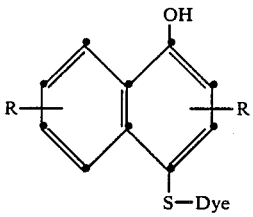

(IV)

where R represents the possible presence of one or more substituents of the many kinds which have been proposed for color couplers, and 'Dye' is as defined for Formula II above.

A compound of Formula III or IV can be prepared by, for example, reacting the chosen coupler with a sulphenyl chloride of Formula Q—L—S—Cl, where L is a link and Q is a group which can be converted to an amino group, to attach a group Q—L—S to the coupling position, converting the group Q to an amino group, and reacting the product with a reactive-derivative of the chosen dye.

A specific example of a dye-coupler of the Formula IV is:

The preparation of this coupler is described in Preparation 1 herein.

2. Pyrazolone dye-couplers of formula I

Pyrazolone dye-couplers useful in materials of the present invention can be represented by the tautomeric formula:

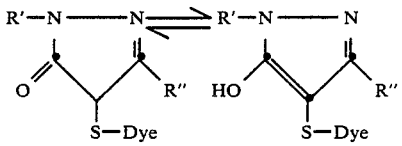

(V)

where each of R' and R'' indicates the possible presence of a substituent of a kind suitable for inclusion in a coupler, and 'Dye' is as defined for Formula I above. When each of R' and R'' indicates a substituent, the two substituents may be the same or different.

Pyrazolone dye-couplers of Formula V can be prepared by the following synthetic route.

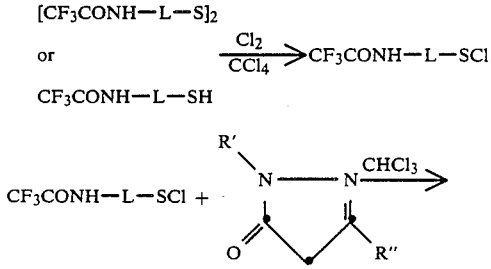

-continued
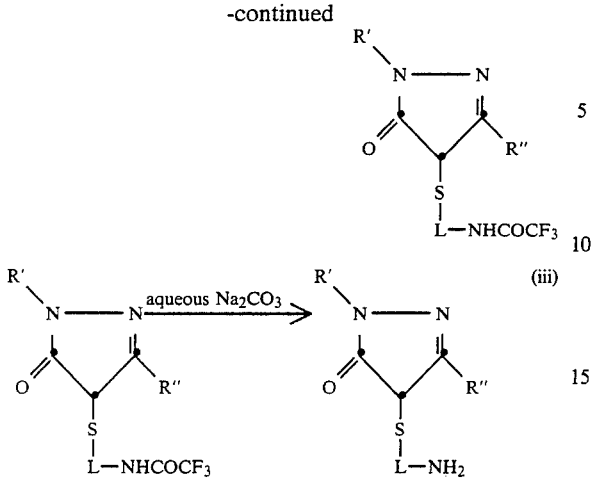
(iii)
-continued
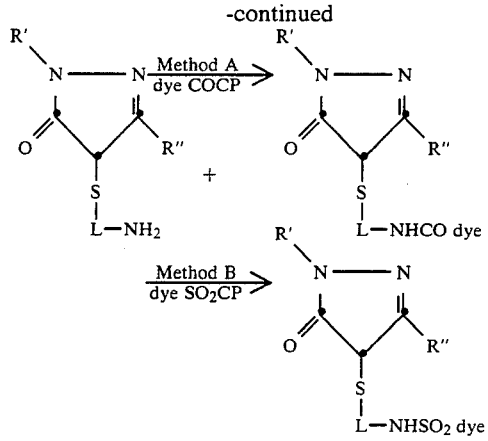
(iv)
where
R' and R'' are as already defined, R' being, for example, a phenyl or substituted phenyl group and R'' being, for example, an alkyl, alkoxy or substituted amino (i.e., alkylamino or acylamino) group,
L is a linking group, and
'dye' is any suitable dye residue, such as that
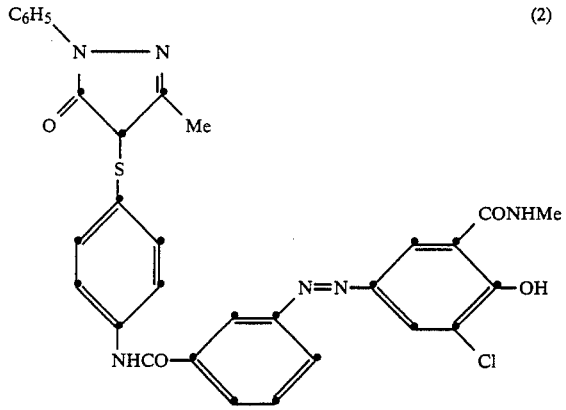
(2)
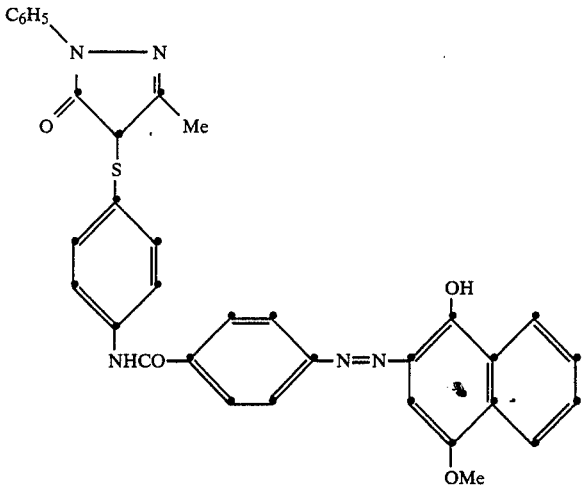
(3)
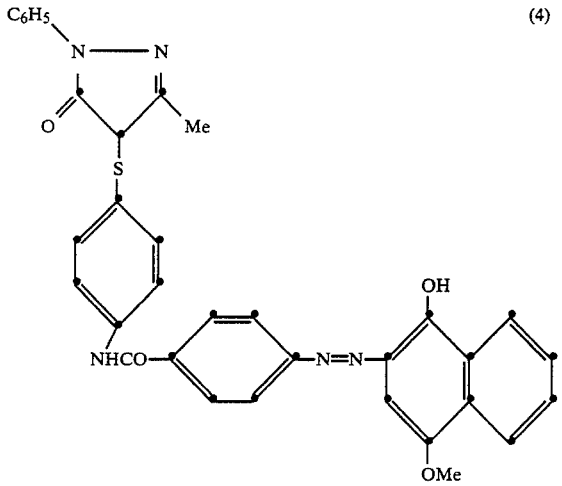
(4)
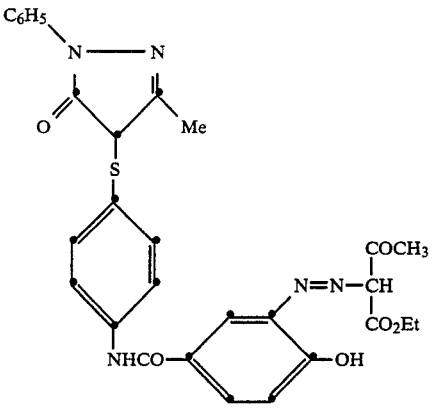
(5)

-continued
(6)
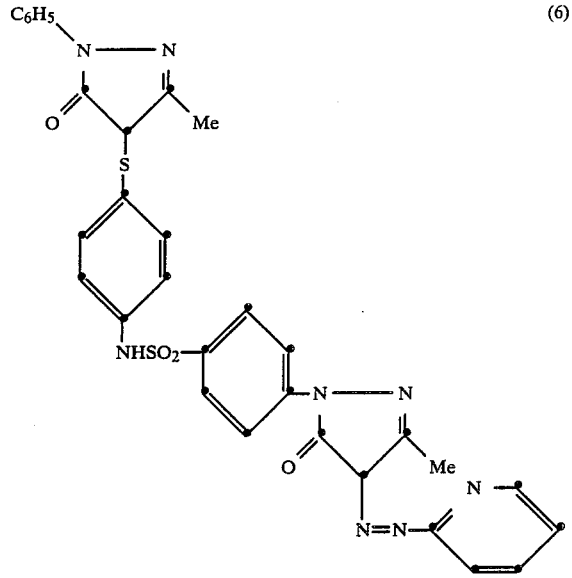
(7)
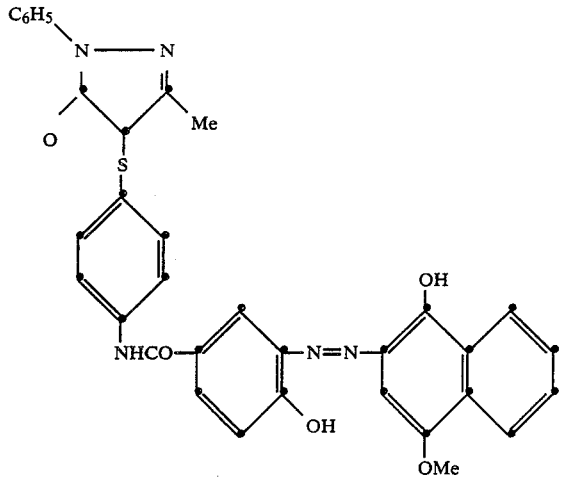
(8)
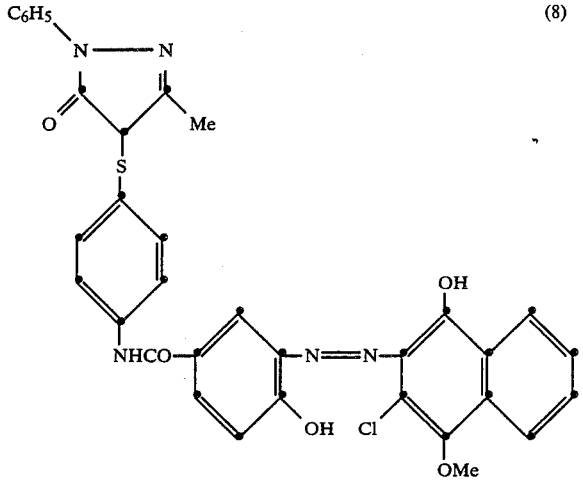
(9)
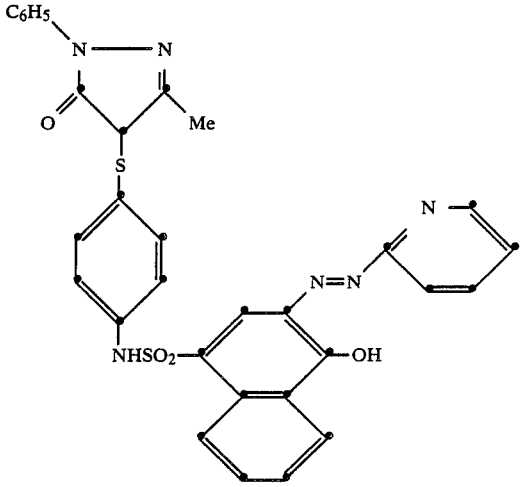
(10)
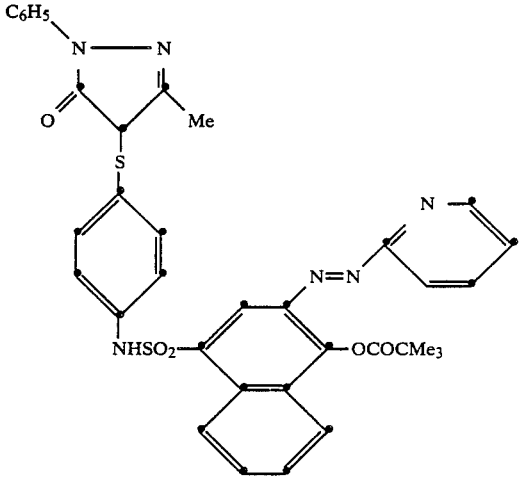
(11)
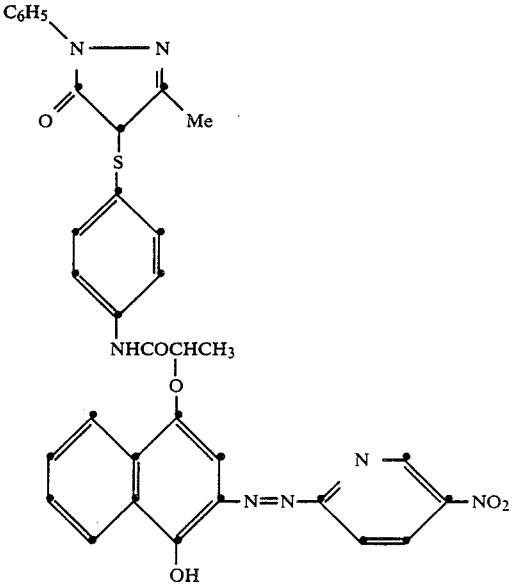

-continued
(12)
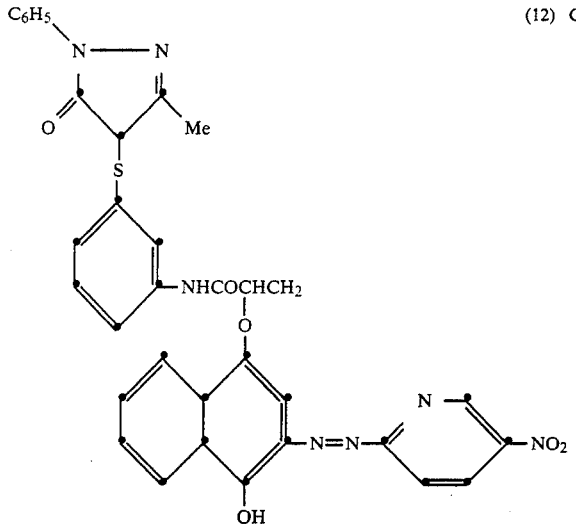
(13)
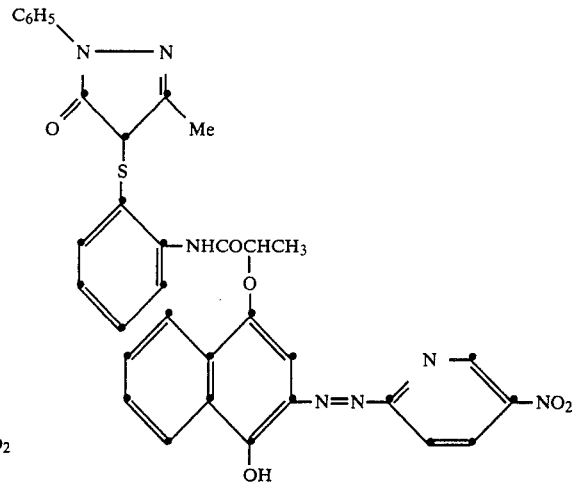
(14)
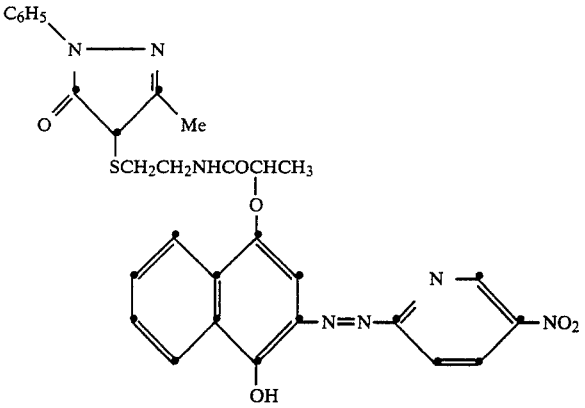
(15)
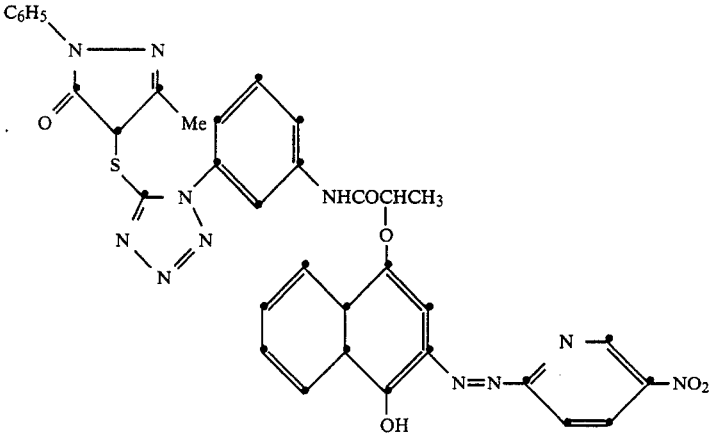

-continued
(16)
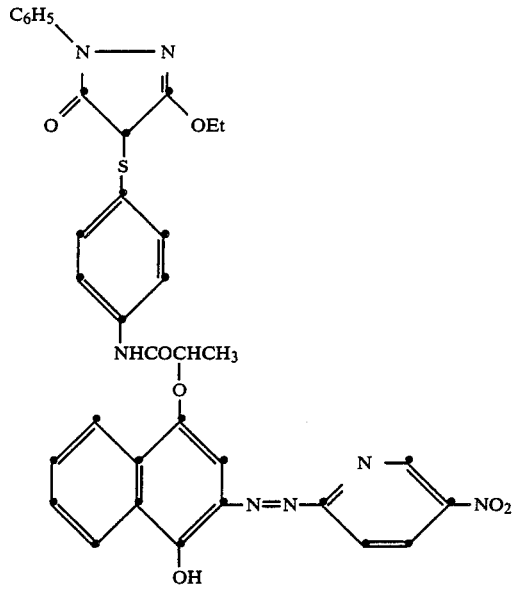
(17)
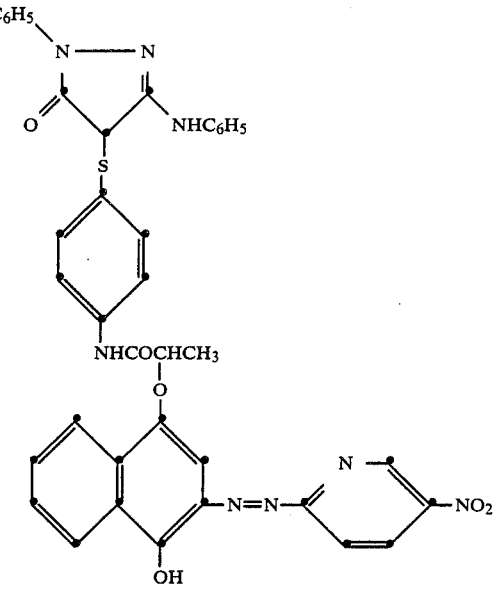
(18)
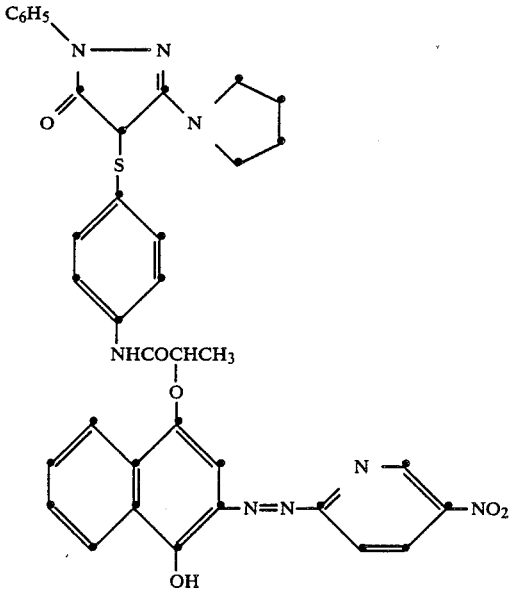
(19)
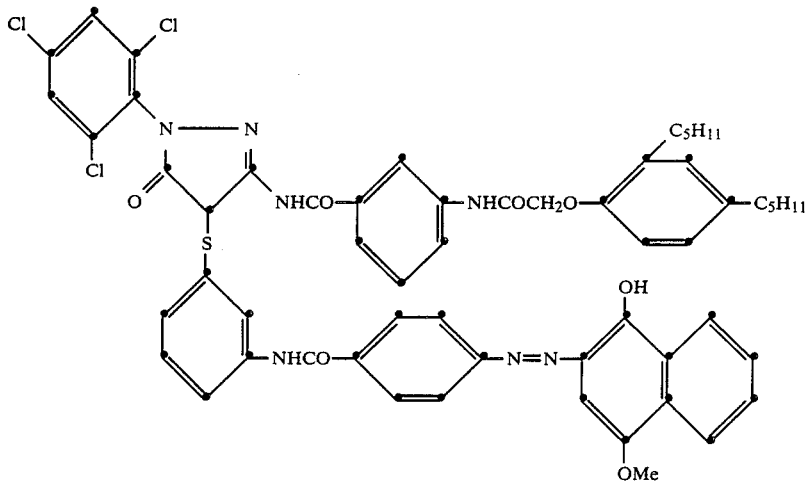

-continued (20)

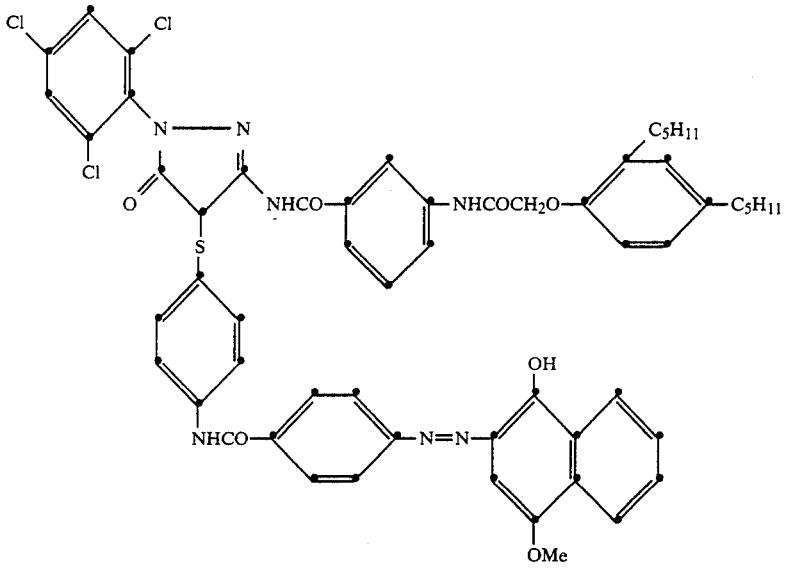

To illustrate the synthetic route outlined above, details of the synthesis of Couplers Nos. 2 and 6 are given hereinafter in Preparation 2.

(3) Pyrazolotriazole dye-couplers of formula I

Pyrazolotriazole dye-couplers which may be used for the for the invention are of the formula:

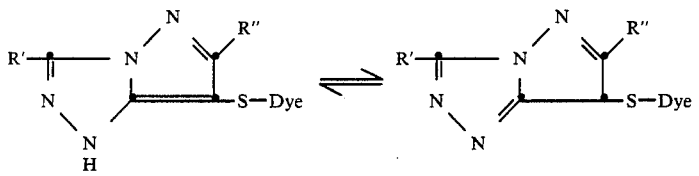

(VI)

wherein R′ and R″ are as defined for Formula (V) and 'Dye' is as defined for Formula I.

(4) Open-chain dye-couplers of Formula I

Open-chain yellow dye-forming dye couplers useful for the invention can be represented by the formula:

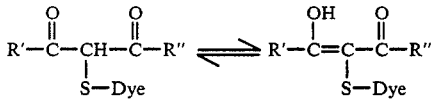

(VII)

where R′ and R″ are as defined for Formula (V) and 'Dye' is as defined for Formula I.

5. Couplers of Formula II derived from open-chain couplers

A coupler of Formula II derived from an open-chain coupler is a heterocyclic compound. For example, the compound:

Coupler No. 21

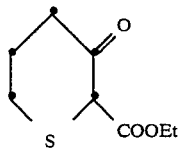

may be considered to be derived from the coupler:

$CH_3COC\overset{*}{H}_2COOEt$ by replacing one hydrogen atom at the coupling position (marked with the asterisk) with a sulfur atom and linking that atom to the acetyl group with a methylene chain.

Coupler No. 22:

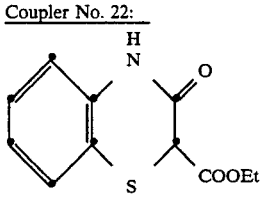

may likewise be considered as a derivative of the coupler:

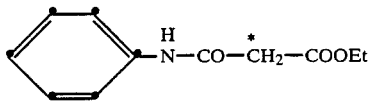

6. Pyrazolone couplers of Formula II

The couplers preferred for use in the materials and processes of the invention, on account of their reactivity, are pyrazolone derivatives represented by the general formula:

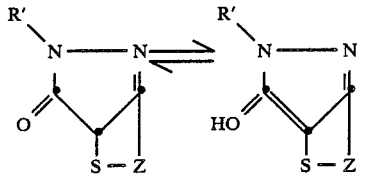

(VIII)

where R′ is defined for Formula V above and Z is as defined for Formula II above. When Z completes the ring by means of two, three or four carbon atoms, Formula VIII is represented as follows:

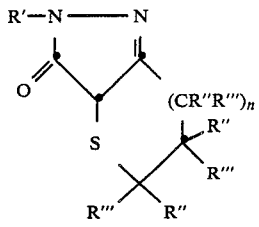

(IX)

wherein n is 0, 1 or 2 and R′ and each R″ and R‴ is hydrogen or a substituent, it being additionally possible for the R′ and R″ on any particular carbon atom together to complete a ring or for the (R″)'s on two adjacent carbon atoms together to complete a ring. Substituents represented by the same symbol in this formula can be the same or different.

Many compounds of the Formula IX can be prepared by the following synthetic route:

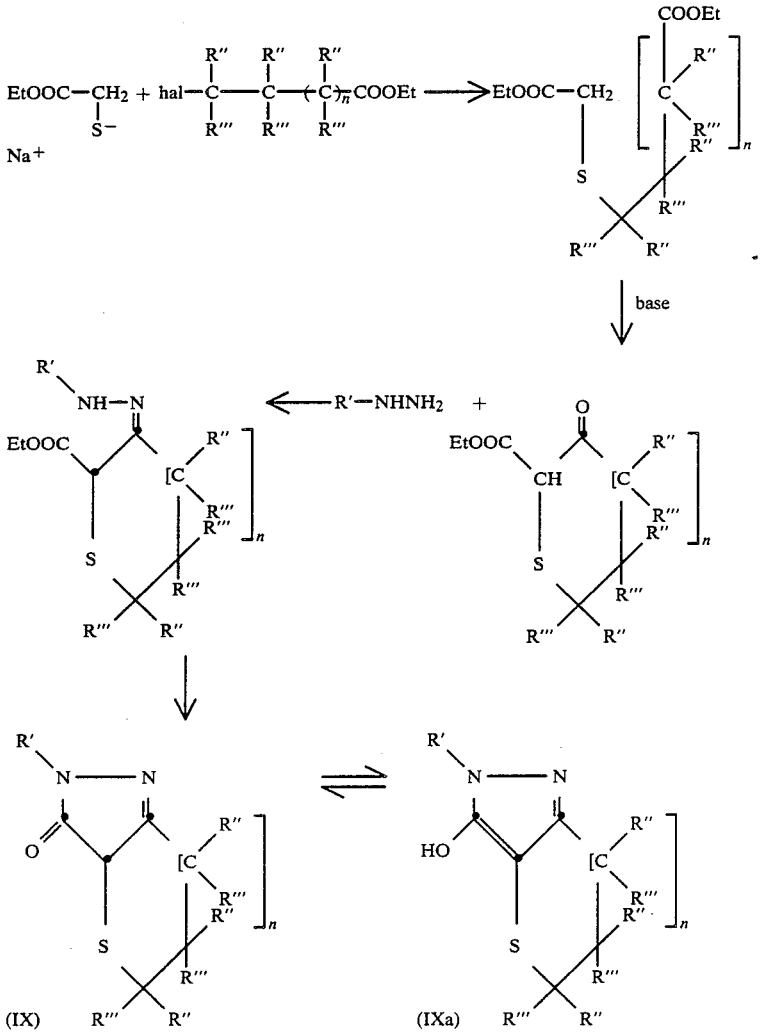

wherein hal represents chlorine, bromine or iodine. As shown, many compounds of Formula IX can exist in an enol form IXa.

The following are examples of coupler classes falling within the general Formula IX.

(i) Thieno[3,2-c]pyrazolones

These are of the general Formula X for the case where n is 0 and are given by the formula:

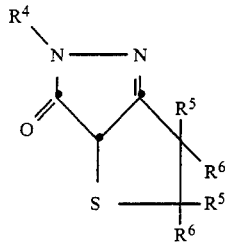

(X)

wherein $R^4$ is hydrogen, or an unsubstituted or substituted alkyl, cycloalkyl, aryl or heterocyclic group, and each of $R^5$ and $R^6$ is hydrogen or an alkyl or aryl group or the $R^5$ and $R^6$ on any particular carbon atom together complete a ring, any $R^5$ and $R^6$ group possibly being substituted.

Examples of couplers of Formula X are compounds in which each $R^5$ and $R^6$ is hydrogen and $R^4$ is as follows:

| Coupler No. | $R^4$ |
|---|---|
| 23 | H |
| 24 | $C_6H_5$ |
| 25 | p-$NO_2$—$C_6H_5$ |

The preparation of Coupler No. 24 is described in Preparation 3 hereinafter.

(ii) Thiopyrano[3,2-c]pyrazolones

These are of the general Formula IX for the case where n is 1 and are in accordance with the formula:

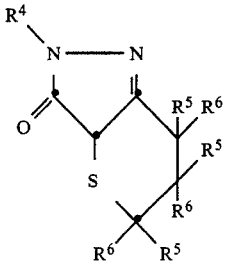

(XI)

wherein $R^4$ to $R^6$ are as defined for Formula X above. The compound in which $R^4$ and each $R^5$ and $R^6$ is a hydrogen atom is referred to herein as Coupler No. 26. Compounds in which $R^4$ is:

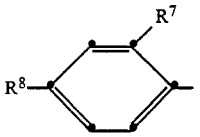

and each of $R^5$ and $R^6$ is hydrogen are specified in the table below, which lists the values of $R^7$ and $R^8$.

| Coupler No. | $R^7$ | $R^8$ |
|---|---|---|
| 27 | H | H |
| 28 | $NO_2$ | H |
| 29 | H | $NO_2$ |
| 30 | $NO_2$ | $NO_2$ |
| 31 | $NO_2$ | $CF_3$ |
| 32 | $CF_3$ | $NO_2$ |
| 33 | $NH_2$ | H |
| 34 | H | $NH_2$ |
| 35 | $NH_2$ | $NH_2$ |
| 36 | $NH_2$ | $CF_3$ |
| 37 | $CF_3$ | $NH_2$ |
| 38 | H | CN |
| 39 | H | —COOEt |
| 40 | H | —$CONHNH_2$ |
| 41 | H | —NHCO(C$_2$H$_5$)CHO—C$_6$H$_4$—$C_{15}H_{31}$ |
| 42 | H | —$NHCO(CH_2)_{10}NH_2$ |
| 43 | H | —$NHCO(CH_2)_{10}NHCOCF_3$ |
| 44 | H | Dye 1 |
| 45 | Dye 1 | H |
| 46 | Dye 1 | Dye 1 |
| 47 | H | Dye 2 |
| 48 | H | Dye 3 |

The groups designated as Dyes 1, 2 and 3 in this table are the following:

Dye 1

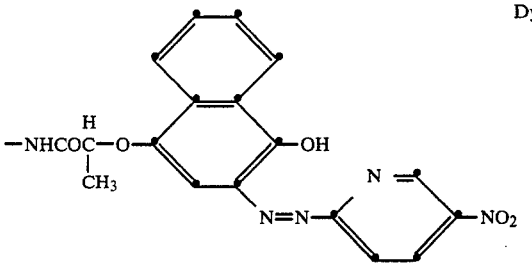

Dye 2

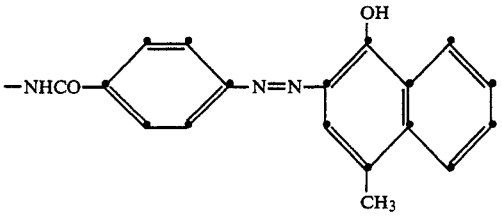

Dye 3

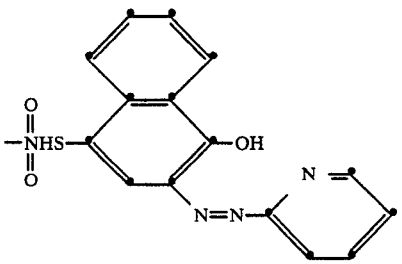

The preparation of Coupler Nos. 24, 29, 34, 41 and 44 is described in Preparation Nos. 3 to 7 herein.

(iii) Thiepino[3,2-c]pyrazolones

These are of the general Formula IX for the case where n is 2 and are given by the formula:

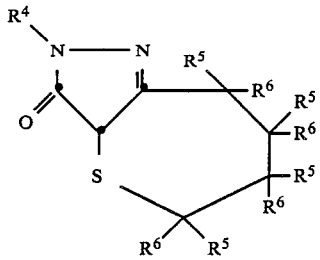

(XII)

wherein $R^4$ to $R^6$ are as defined for Formula X above. Examples of compounds of Formula XII are the Couplers Nos. 49 to 56 specified in the table below. In these compounds, each $R^5$ and $R^6$ is hydrogen and $R^4$ is:

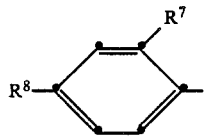

where $R^7$ and $R^8$ have the tabulated values:

| Coupler No. | $R^7$ | $R^8$ |
|---|---|---|
| 49 | H | H |
| 50 | H | $NO_2$ |
| 51 | H | $NH_2$ |
| 52 | $NO_2$ | $CF_3$ |
| 53 | H | —NHCOCHO(C$_2$H$_5$)—C$_6$H$_4$—C$_{15}$H$_{31}$ |
| 54 | H | Dye 1 |
| 55 | H | Dye 4 |
| 56 | H | Dye 5 |

The substituent 'Dye1' is defined above with reference to Couplers 44 to 46. The sbustituents 'Dye 4' and 'Dye 5' are as follows:

Dye 4

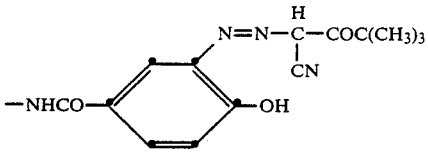

Dye 5

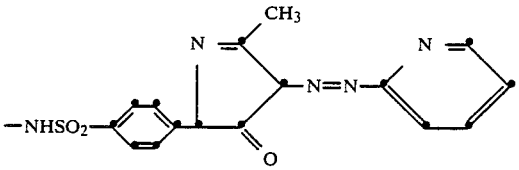

These couplers were made by methods analogous to those described in Preparations 3 to 6 hereinafter, starting with the β-ketoester of formula:

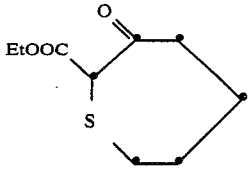

(iv) Dithiino[5,4-c]pyrazolones

These are of the general formula:

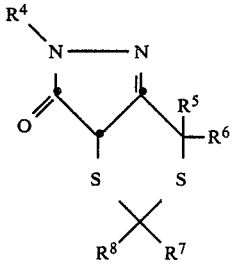

(XIII)

wherein $R^4$ is as defined for Formula X above and each of $R^5$, $R^6$, $R^7$ and $R^8$ is hydrogen or an unsubstituted or substituted alkyl or aryl group, or $R^5$ and $R^6$ together and/or $R^7$ and $R^8$ together complete a ring. Examples of compounds of Formula XIII are the Couplers 57 to 67 specified in the table below. In this table $C_6H_3R^9R^{10}$— designates the structure:

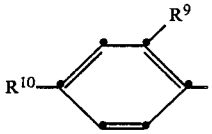

| Coupler No. | $R^4$ | $R^7$ | $R^8$ | $R^9$ | $R^{10}$ |
|---|---|---|---|---|---|
| 57 | $C_6H_5$— | H | H | H | H |
| 58 | $C_6H_3R^9R^{10}$ | H | H | H | $NO_2$ |
| 59 | $C_6H_3R^9R^{10}$ | H | H | H | $NH_2$ |
| 60 | $C_6H_5$ | H | $C_6H_5$ | H | H |
| 61 | H | H | $C_6H_5$ | — | — |
| 62 | $C_6H_3R^9R^{10}$ | —$(CH_2)_5$— | | H | H |
| 63 | H | —$(CH_2)_5$— | | — | — |
| 64 | $C_6H_3R^9R^{10}$ | —$(CH_2)_5$— | | H | $NO_2$ |
| 65 | $C_6H_3R^9R^{10}$ | —$(CH_2)_5$— | | H | $NH_2$ |
| 66 | $C_6H_3R^9R^{10}$ | H | H | H | A* |
| 67 | $C_6H_3R^9R^{10}$ | H | H | H | Dye 1 |

A* is —NHCOCH$_2$O—C$_6$H$_4$—C$_5$H$_{11}$(t) (with C$_5$H$_{11}$(t) also on the ring)

The Couplers 57 to 67 were made by the following synthetic route:

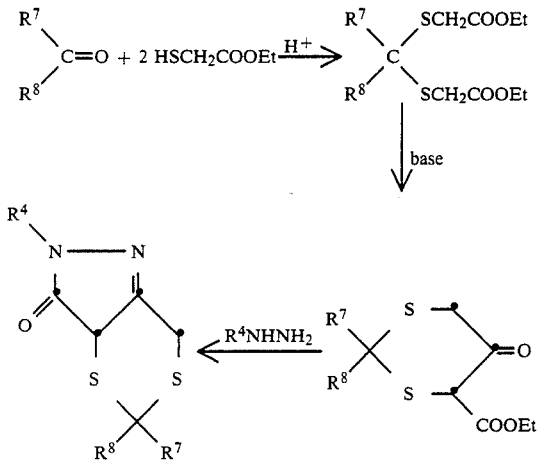

The methods of synthesizing Couplers Nos. 61 and 63 are described hereinafter in Preparations 8 and 9.

(v) Pyrazolo[4,3-b][1,4]benzothiazin-3-ones

These are of the general formula:

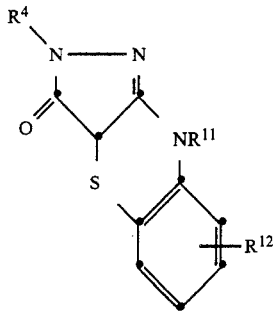

wherein $R^4$ is as defined for Formula X, $R^{11}$ is hydrogen or an alkyl or acyl group and $R^{12}$ indicates the possible presence of one or more substituents, such as alkyl, for example, methyl, ethyl, propyl and butyl; alkyloxy, such as methoxy and ethoxy; aryloxy such as phenoxy; chloro; cyano; nitro; amino; sulfo; alkylamido, such as methylamido; or arylamido, such as phenylamido.

Compounds of formula are the following.

| Coupler No. | $R^4$ | $R^{11}$ | $R^{12}$ |
|---|---|---|---|
| 68 | H | H | H |
| 69 | $C_6H_5$— | H | H |
| 70 | p-$NO_2.C_6H_4$ | H | H |
| 71 | $C_6H_5$ | $CH_3$ | H |

Compounds of the Formula XIV were synthesized by the following route.

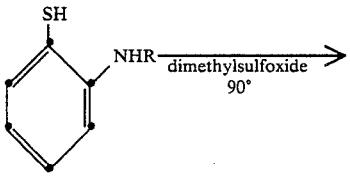

-continued

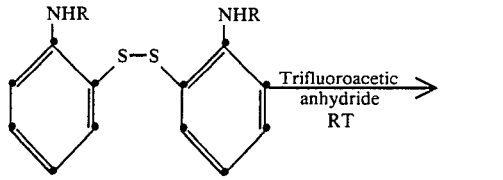

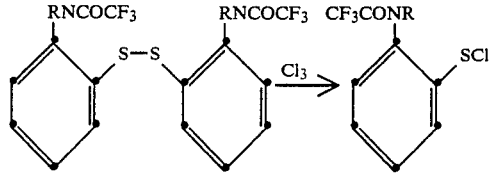

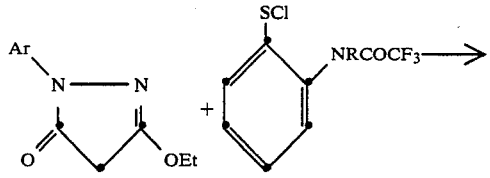

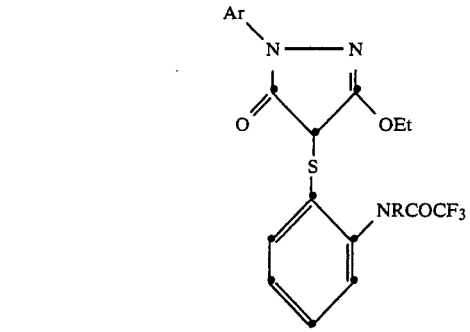

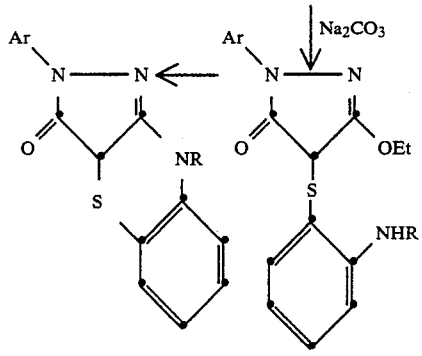

(Ar herein means aryl, such as phenyl)

(R herein means a substituent which does not adversely affect coupling activity)

The synthesis of Coupler No. 69 is described in Preparation 10 hereinafter.

(vi) [1]Benzothiopyrano[3,2-c-]pyrazolones

These are of the general formula:

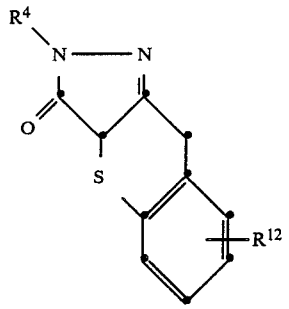

(XV)

wherein $R^4$ and $R^{12}$ are as defined for Formulae X and XIV respectively. An example of a compound of this formula is Coupler No. 72 in which $R^4$ is phenyl and no $R^{12}$ substituent is present.

Compounds of this class were obtained by reaction of the cyclic β-ketoester (a) with an arylhydrazine. The synthesis of the intermediate (a) is described in J. Org. Chem., 1969, 34(6), 1566–72 and illustrated by the following reaction sequence.

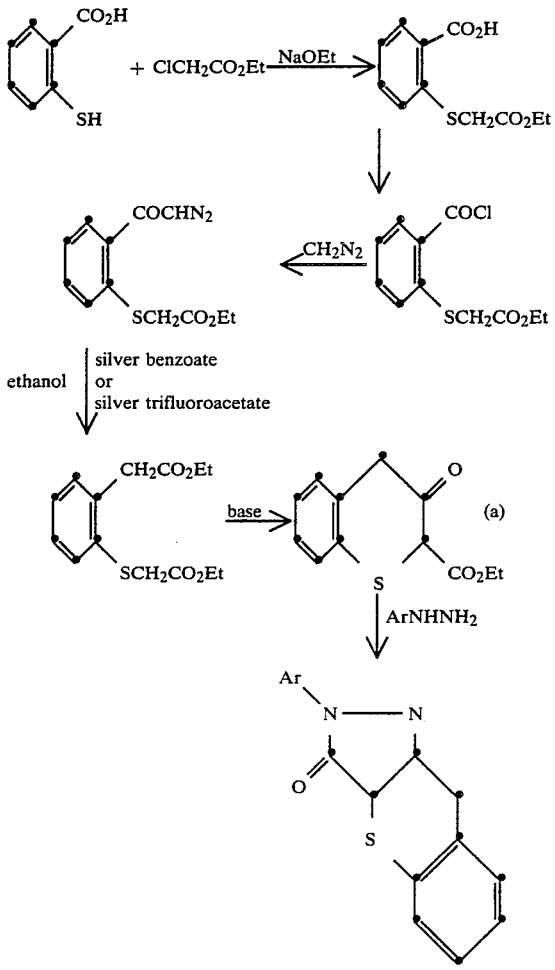

(vii) Pyrazolo[4,3-b]thiazoles

These are of the general formula:

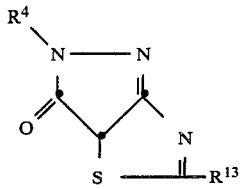

(XVI)

where $R^4$ is as defined for Formula X above and $R^{13}$ is $NCHC_6H_5$.

An example of a compound of Formula XVI is Coupler No. 73 for which $R^4$ is phenyl and $R^{13}$ is phenylamino.

The layer or layers of photothermographic elements of the invention can be prepared using either hydrophilic or hydrophobic binders. The choice of binder is governed by the choice of other components of the material, especially the reducible organic silver salt, and by the intended method of diffusion transfer. When the silver salt is of a heterocyclic compound, such as triazole, a hydropilic binder is more suitable, gelatin, polyacrylamide, polyvinyl alcohol and hydroxyethylcellulose being examples. When the silver salt is of a long chain fatty acid, such as stearic or behenic acid, a hydrophobic binder is appropriate, polyvinyl butyral, cellulose acetate, ethyl cellulose and polystyrene being examples.

Reference to documents giving details of binders for photothermographic elements are given in section XI of Research Disclosure, Item 17029.

Sensitive photothermographic elements of the invention may contain any of those constituents which are useful in photothermographic elements, including antifoggants, activators (and their precursors), base release agents, development modifiers, and melt formers. References to patent specifications and other literature describing such constituents are given in Research Disclosure, Item 17029.

A photothermographic element of the invention may contain a receiving layer to which a dye-coupler may diffuse imagewise from an adjacent layer, possibly through an opaque white layer which serves as a background for viewing the image. The receiving layer is preferably formed of, or contains, a mordant. Polymeric mordants include polymers having quaternary salt groups in the backbone or as substituents. Other mordants, which can be incorporated in a binder, include metal ions, these being suitable where the dye is metallizable.

An approximate guide to the coverage of the principal constituents in a photothermographic element of the invention is given in the following table.

| Constituent | Coverage (m mol per $m^2$) Range | Typical Value |
|---|---|---|
| (a) silver halide | 0.3 to 30 | 6 |
| (b) organic silver salt | 0.5 to 20 | 6 |
| (c) developing agent | 0.1 to 3 | 0.4 |
| (d) coupler | 0.05 to 2 | 0.3 |
| (e) binder | 0.5 to 10 | 1.5 |
| (f) antifoggant | 0.1 to 5 | 1 |

It is preferred for the molar concentration of the developing agent to be at least equal to that of the coupler.

The essential constituents of a photothermographic element of the invention can be incorporated in a single layer or in adjacent layers which at the intended processing temperature, allow the necessary reaction to occur. The layer or layers can contain more than one coupler if it is desired to produce a monochrome image having wider spectral absorption. A multicolor photothermographic element can be made by using layers of photographic silver halide of different spectral sensitivity containing different couplers. For example, the conventional arrangement of red-, green- and blue-sensitive silver halide layers providing, respectively, cyan, magenta and yellow dye images can be adopted.

An image is obtained in an exposed photothermographic element by a process which comprises overall heating the element. Exposure of the photothermographic element is by means of any radiation which can form a latent image in the silver halide, and so may be, for example, light, ultraviolet radiation, x-radiation, or an electron beam. Overall heating is conveniently effected by any heating means which produces the desired processing temperature in the element, such as holding the exposed element in contact with a heated metal platen or by passing the element between heated rollers. A processing temperature within the range of 80° to 200° C. is usually necessary, a value in the range of 125° to 175° C. being preferred. The time of heating can be varied depending upon the processing temperature and the particular element of the invention. A dye image is generally produced within about 2 to about 90 seconds.

Whether or not it is necessary to transfer an imagewise distribution of unreacted coupler (or dye coupler) from the layer in which it is formed depends upon the nature of the coupler and the type of image required. A coupler of the general Formula II which is not a dye gives a negative dye image on heat-processing which may be all that is required. However, the positive distributions of unreacted coupler and developing agent can be transferred by diffusion to a receiving layer where they can react in the presence of, for instance, a silver salt to give a positive dye image.

The preferred photothermographic elements of the invention contain dye-couplers, those of Formula II being particularly preferred, and it is the unreacted dye-coupler which gives the desired image, being transferred by diffusion away from the colored product of the coupling reaction to a receiving layer. If that product is itself diffusible, as when the dye-coupler is of Formula I, it has to be removed in some way, for instance by washing. The diffusion transfer of the unreacted dye-coupler may be accomplished simply by heating when appropriately composed layers, possible containing a melt-former, are concerned. Wetting of the layer with a solvent for the dye-coupler which swells the binder present is, however, desirable in many cases for speeding the transfer. For example, when the sensitive and receiving layers are formed with hydrophilic binder, a water-organic silvent mixture can be used, suitable water-miscible solvents being cyclohexanone, methanol and ethanolamine.

Illustrative preparations of couplers and dye-couplers of a number of the classes described are as follows:

Preparation 1 (Coupler No. 1)

(a) 5-Acetamido-4-(3-nitrophenylthio)-2-naphthol

Bis-(m-nitrophenyl)-disulfide (3.1 g) was suspended in dry carbon tetrachloride (20 ml) and chlorine gas was passed into the mixture for 1 hour, allowing the temperature to reach 80° C. The mixture was cooled and filtered, and the filtrate was concentrated to an oil by rotary evaporation. The oil was dissolved in dry chloroform (50 ml) and was added to a solution of 5-acetamido-1-naphthol (4.0 g) in dry chloroform (50 ml). A sticky mass was obtained and tetrahydrofuran was added until the mass dissolved. The solution was heatred under reflux for 2½ hours, and was then concentrated to a dark oil by rotary evaporation. The oil was stirred with methanol to give 4.6 g of a solid, which after recrystallization from methanol (90 ml) gave 3.2 g (46%) of pure product of the formula:

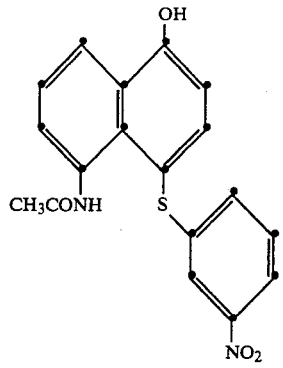

(b) 5-Acetamido-4-(3-aminophenylthio)-1-naphthol

5-Acetamido-4-(3-nitrophenylthio)-1-naphthol (1.0 g), iron pin dust (3.0 g), ethanol (25 ml) and concentrated hydrochloric acid (0.05 ml) were stirred and heated under reflux for 24 hours. Sodium carbonate (0.1 g) was heated to the hot mixture which was then filtered through keiselguhr. The filtrate was concentrated to dryness by rotary evaporation. The solid was stirred with a little ethanol and insoluble material was filtered off (0.2 g). The ethanol filtrate was diluted with water to give another 0.55 g of product. Total yield 0.75 g (82%).

(c) Coupler No. 1

3-(2-Hydroxynaphth-1-ylazo)-4-[3-(3-pentadecylphenoxy-1-butyramido)benzoyloxy]benzoyl chloride (1.74 g) was added to a solution of 5-acetamido-4-(3-aminophenylthio)-1-naphthol (0.69 g) in tetrahydrofuran (30 ml) containing N,N-dimethylaniline (0.3 g). The mixture was stirred at room temperature for 1½ hours then it was poured into dilute hydrochloric acid. The precipitate was filtered off, washed with water and dried, 2.35 g. The solid was purified by column chromatography using Florisil TM silica gel as stationary phase and eluting first with chloroform to remove a front running component, then with ethyl acetate to remove the desired dye-coupler, 1.6 g (68%).

Preparation 2 (Couplers Nos. 2 and 6)

These couplers were made by the Methods A and B of the synthetic route given above for Formula V couplers. In each case -L- was p-phenylene, R′ was phenyl and R″ was methyl.

N-[p-(5-Hydroxy-3-methyl-1-phenylpyrazol-4-ylthio)-phenyl]trifluoroacetamide

Chlorine gas was passed into a stirred suspension of di(p-trifluoroacetamidophenyl)disulfide (2.2 g) in dry carbon tetrachloride (100 ml) for 1 hour while maintaining a temperature of 60° C. The mixture was then filtered and concentrated to a solid by rotary evaporation. The solid was dissolved in dry chloroform (30 ml) and was added to a stirred suspension of 3-methyl-1-phenyl-5-pyrazolone (1.74 g) in dry chloroform (30 ml). The mixture was heated under reflux for 24 hours then cooled. A solid was filtered off, washed with chloroform, dried and was recrystallized from ethyl acetate to give 2.0 g of product (51%).

p-5-Hydroxy-3-methyl-1-phenylpyrazol-4-ylthio)aniline

N-[p-(5-Hydroxy-3-methyl-1-phenylpyrazol-4-ylthio)phenyl]trifluoroacetamide (2.0 g) was dissolved in 3N sodium carbonate (20 ml), and water (20 ml) was added. The solution was heated on a steam-bath for 3 hours, then it was cooled and filtered, and the filtrate was acidified with glacial acetic acid. The precipitate was filtered off, washed with water and dried to give 1.4 g (90%) of pure amine.

Coupler 2 (Method A)

m-(3-Chloro-4-hydroxy-5-(N-methylcarbamoyl)-phenylazo]benzoyl chloride (1.03 g) was added to a solution of p-(5-hydroxy-3-methyl-1-phenylpyrazol-4-ylthio)aniline (0.87 g) in tetrahydrofuran (50 ml) containing N,N-dimethylaniline (0.7 ml) and the mixture was stirred at room temerature for 18 hours. The mixture was then poured into ice/hydrochloric acid and the precipitate was filtered off, washed and dried to give 1.76 g (98%) of pure product.

Coupler 6 (Method B)

p-(5-Hydroxy-3-methyl-1-phenylpyrazol-4-ylthio)aniline (1.5 g) was dissolved in tetrahydrofuran (50 ml) containing pyridine (10 ml). p-[5-Hydroxy-3-methyl-4-(pyrid-2-ylazo)pyrazol-1-yl]benzenesulfonyl chloride (1.94 g) was added and the mixture was stirred at room temperature for 18 hours. The mixture was poured into ice/hydrochloric acid and the solid was filtered off, washed with water and dried (3.45 g). The solid was dissolved in a mixture of 3N sodium hydroxide and methanol and the solution was stirred at room temperature for 15 minutes. Glacial acetic acid was added and the precipitate was filtered off (3.0 g). The solid was boiled with tetrahydrofuran and a small amount of insoluble material was filtered off. The filtrate was concentrated to give a solid which was digested with hot methanol then cooled. The dye-coupler was filtered off and dried, 2.45 g (67%).

Preparation 3 (Coupler No. 24)

Equimolar quantities of the compounds:

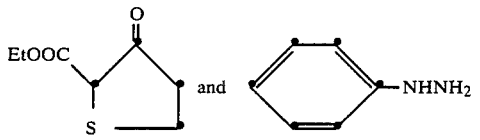

were heated in ethanol on a steam-bath for 45 minutes. The solution was cooled and the resulting hydrazone was filtered off. The hydrazone was dissolved in methanol and a solution of sodium (5% excess) in methanol was added. The mixture was heated under reflux and then cooled, filtered and poured into dilute aqueous acetic acid. The resulting solid, the desired Coupler No. 24 was filtered off and recrystallized from ethanol.

Preparation 4 (Coupler No. 29)

Equimolar quantites of the compounds:

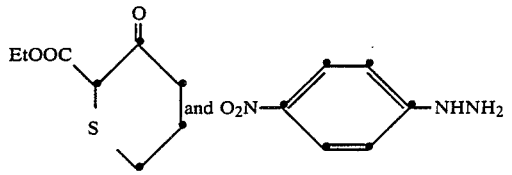

dissolved in glacial acetic acid were heated for 30 minutes on a steam bath. The mixture was cooled and the resulting solid, the desired coupler, was recrystallized from glacial acetic acid.

Preparation 5 (Coupler No. 34)

Coupler No. 29 was dissolved in tetraydrofuran and shaken over 10% palladium on charcoal catalyst with hydrogen at room temperature until hydrogen uptake ceased (24 hours). The catalyst was filtered off and the filtrate was concentrated to dryness under reduced pressure. The residue was recrystallized from 50% aqueous ethanol to give a 92% yield of the desired Coupler No. 34.

Preparation 6 (Coupler No. 41)

Coupler No. 34 was dissolved in tetrahydrofuran containing N,N-dimethylaniline (5% excess). An equimolar quantity of the acid chloride:

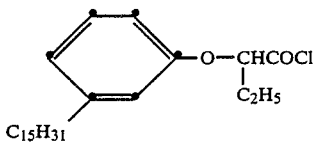

was added and the mixture was stirred at room temperature for 20 hours. The mixture was poured into dilute aqueous hydrochloric acid and the resulting oil was extracted with ethyl acetate. The extracts were dried over magnesium sulfate monohydrate and were concentrated by distillation under reduced pressure. The residual gum was crystallized from methanol.

Preparation 7 (Coupler No. 44)

2-{4-[1-Hydroxy-2-(5-nitropyrid-2-ylazo)-naphthoxy]}propionic acid (0.6 g) was stirred in dry methylene chloride (25 ml) and thionyl chloride (0.75 ml) was added, followed by pyridine (25 drops). The mixture was stirred at room temperature for ten minutes, then it was concentrated to dryness by distillation under reduced pressure. The residue was stirred with tetrahydrofuran (30 ml) and insoluble material was filtered off. The tetrahydrofuran solution was added to a mixture of the Coupler No. 34 (0.35 g), N,N-dimethylaniline (0.4 ml) and tetrahydrofuran (35 ml). After being stirred at room temperature overnight the mixture was concentrated under reduced pressure to low bulk and water was added. The solid was filtered off and dried. Recrystallization from tetrahydrofuran gave 0.36 g of the desired dye-coupler, Coupler No. 44.

Preparation 8 (Coupler No. 61)

Equimolar quantities of the compounds:

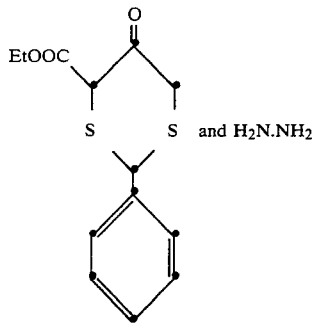

in ethanol were heated under reflux for 15 minutes. The mixture was cooled and the resulting solid filtered off and recrystallized from ethanol.

Preparation 9 (Coupler No. 63)

Equimolar quantities of the compounds:

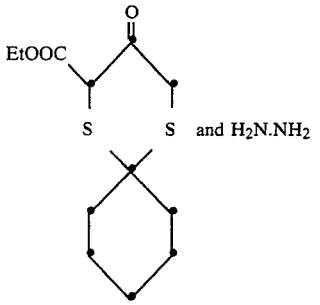

were heated together on a steam bath for 90 minutes. The resulting solid was recrystallized from ethanol.

Preparation 10 (Coupler No. 72)

The equations showing the synthetic route are given in section (vi) above.

Details of the preparation of ethyl thiochroman-3-one-2-carboxylate (d) are given in J. Org. Chem., 1969, 34(6), 1966. This compound (0.5 g) and phenylhydrazine (0.24 g) were mixed and heated on a steam bath for 1 hour. Acetonitrile (6 ml) was added, and the mixture was heated until the dark gum dissolved. A solid was precipitated while heating. The mixture was cooled and stirred until a fine solid was obtained. The solid was filtered off, washed with acetonitrile and dried, 0.31 g (52%) m.p. 249°-51° (decomp).

The following examples are included for a further understanding of the invention.

EXAMPLE 1

Dye-bearing coupler, 0.15 g, was dissolved in N-n-butyl acetanilide, 1.2 ml. Where necessary, up to 0.3 ml of dimethylformamide was added to help the solid dissolve. To the resulting solution was added 10 ml of a 6% (w/v) solution of gelatin in water, pH 4.0, (hereafter called 6% gelatin), 0.02 g of sodium lauryl sulfate, and 0.2 ml of Alkanol B TM, an aqueous solution of sodium triisopropyl naphthalene sulfonates. The hydrophobic N-n-butylacetanilide solution was dispersed in the aqueous phase with a high shear mechanical emulsifying device, to form an oil-in-water emulsion of the dye-bearing coupler dissolved in droplets of N-n-butylacetanilide, the droplet diameter being of the order of 1 μm.

To 1.0 ml of this dispersion was added a volume (as stated in Table 1) of a solution of the developing agent β-methanesulfonamidoethyl ethylaminotoluidine sesquisulfate, 4.4 g, dissolved in 100 ml of water, the pH of this solution having been adjusted to 3.5 by addition of sodium bicarbonate.

To this mixture was added 2.0 ml of 6% gelatin and 2.0 ml of water, the water having dissolved in it 0.02 gf of propionamide and 0.02 g of sym-dimethylurea. Antifoggant solution (0.60 g of 1-phenyl-2-tetrazoline-5-thione and 0.30 g of 5-methylbenzotriazole, dissolved in 8.0 ml methanol) was added as in Table 3. Finally, under safelight conditions, 2.0 ml of silver bromide/benzotriazole dispersion was added, the dispersion consisting of equal volumes of silver bromide photographic negative emulsion (0.5 nm cubic grains, sulfur plus gold sensitized, 50 g/l in gelatin and 1M in silver bromide) and silver benzotriazole dispersion (3.0 g of silver benzotriazole, 3.0 g of 6% gelatin, and 27.0 ml water, ball-milled for 16 hours or more). The mixture was coated with a coating knife at approximately 0.1 mm wet thickness (100 ml $m^{-2}$) onto Estar TM photographic film base and dried.

Portions of each coating were exposed to sensitometric light source and developed by contacting them against a curved metal block maintained at 150° C. until a strong negative image was visible under the safelight, typically requiring 10 to 30 seconds.

The dye image was transferred to a mordant receiver sheet (containing the mordant copoly[styrene(N-vinylbenzyl-N-benzyl-N,N-dimethyl)ammonium chloride], dispersed in gelatin and coated on polyethylene coated paper) by laminating the test coating to the mordant receiver sheet which had been wetted with a mixture of methanol:cyclohexane:water, 75:25:10. The layers were left in face-to-face contact for 2 minutes at room temperature, then peeled apart. In every case, image dye had transferred to the receiver sheet as had a strong negative image in magenta coupled dye. The receiver sheet was dipped briefly in dilute aqueous sodium carbonate solution to mordant the image dye, and was then washed in methanol. The magenta coupled dye, which was not mordanted, was washed away, leaving in every case a clear positive image in the required image dye.

The dye-bearing couplers used and the volumes of developer and antifoggant solutions coated are listed in Table I. Also listed are the maximum density (Dmax) and minimum density (Dmin) in the transferred image, corresponding to unexposed and fully exposed areas respectively. The densities were measured by reflection through blue, green or red filters depending whether the dye hue was yellow, magenta or cyan respectively.

TABLE 1

| Coupler No. | Developer solution, ml | Antifoggant solution, ml | Transferred image Dmax | Dmin | Color |
|---|---|---|---|---|---|
| 4 | 1.0 | 0.2 | 0.56 | 0.35 | magenta |
| 5 | 0.8 | 0.3 | 0.75 | 0.44 | yellow |
| 6 | 0.5 | 0.3 | 0.49 | 0.18 | yellow |
| 7 | 0.7 | 0.3 | 0.71 | 0.38 | cyan |
| 8 | 0.8 | 0.3 | 1.17 | 0.39 | cyan |

TABLE 1-continued

| Coupler No. | Developer solution, ml | Antifoggant solution, ml | Transferred image Dmax | Dmin | Color |
|---|---|---|---|---|---|
| 9 | 0.5 | 0.3 | 0.91 | 0.28 | magenta |
| 10 | 0.8 | 0.3 | 0.36 | 0.14 | magenta |
| 11 | 0.8 | 0.3 | 1.38 | 0.38 | cyan |
| 12 | 0.8 | 0.3 | 1.67 | 0.56 | cyan |
| 13 | 0.5 | 0.3 | 0.58 | 0.29 | cyan |
| 14 | 0.5 | 0.3 | 0.66 | 0.27 | cyan |
| 15 | 0.5 | 0.3 | 0.84 | 0.45 | cyan |
| 16 | 0.8 | 0.3 | 1.39 | 0.30 | cyan |
| 17 | 0.5 | 0.3 | 0.48 | 0.27 | cyan |
| 18 | 0.8 | 0.3 | 0.76 | 0.45 | cyan |
| 19 | 1.0 | 0.2 | 1.22 | 0.58 | magenta |
| 20 | 0.5 | 0.2 | 1.38 | 0.89 | magenta |

EXAMPLE 2

This example illustrates the preparation of a two-color material.

Dispersions of dye-bearing couplers 2 and 3 were separately prepared as in Example 1. A developer solution and an antifoggant solution were also prepared as in Example 1, and the 6% gelatin solution was as in Example 1.

Green-sensitive magenta layer

A green-sensitive silver dispersion was prepared by taking 8 ml of silver bromide photographic emulsion as in Example 1, and adding to it at 40° C., 0.65 ml of a 1/1000 (w/v) solution in methanol of the spectral sensitizing dye anhydro-5,5',6,6'-tetrachloro-1,1',3-triethyl-3'-(3-sulfobutyl)benzimidazolocarbocyanine hydroxide.

The dyed emulsion was maintained at 40° C. for approximately 15 minutes, then was added 16 ml of silver benzotriazole dispersion as in Example 1.

Then the following mixture was prepared, coated as in Example 1 on Estar TM photographic film base, and dried.

| | |
|---|---|
| dispersion of magenta dye-bearing coupler | 2.0 ml |
| developer solution | 1.0 ml |
| dimethyl urea | 0.02 g |
| propionamide | 0.02 g |
| water | 3.0 ml |
| antifoggant solution | 0.3 ml |
| green-sensitive silver dispserion | 2.0 ml |
| Triton X-200 TM | 0.1 g |
| Surfactant 10G TM | 0.007 g |

Interlayer

An interlayer which absorbed blue light was coated on top of the dry-green sensitive magenta layer at approximately 100 ml $m^{-2}$ wet laydown. The composition of the interlayer was as follows:

| | |
|---|---|
| colloidal silver dispersion* | 3.0 g |
| 6% gelatin | 35 g |
| polyethyleneglycol, M.W. 6000 | 1.5 g |
| butyl urea | 0.4 g |
| developer solution | 8.0 ml |
| benzotriazole | 0.5 g |
| 1-phenyl-2-tetrazolin-5-thione | 0.028 g |
| methanol | 1.0 ml |
| water | 60 ml |
| Triton X-200 TM | 0.07 g |
| Surfactant 10G TM | 0.05 g |

*This aqueous dispersion contained approximately 5% w/v colloidal silver and 10% w/v gelatin, and was deep yellow-brown in color.

When dry, the coating was supercoated with a blue-sensitive yellow layer.

Blue-sensitive yellow layer

A blue-sensitive silver dispersion was prepared by mixing together 8 ml of silver bromide photographic emulsion as in Example 1, and 16 ml of silver benzotriazole dispersion as in Example 1.

Then the following mixture was prepared, coated at approximately 100 ml $m^{-2}$ on top of the interlayer, and dried.

| | |
|---|---|
| dispersion of yellow dye-bearing coupler 2 | 1.0 ml |
| developer solution | 0.5 ml |
| dimethyl urea | 0.02 g |
| propionamide | 0.02 g |
| polyethylene glycol, M.W. 6000 | 0.025 g |
| 6% gleatin | 1.0 ml |
| water | 3.5 ml |
| antifoggant solution | 0.3 ml |
| blue-sensitive silver dispersion | 2.0 ml |
| Triton X-200 TM | 0.01 g |
| Surfactant 10G TM | 0.007 g |

Testing

A portion of the dry coating was exposed to a sensitometric test object having blue, green and white optical step wedges. It was developed by heating face up on a curved metal block at 150° C. for 30 seconds, and the image transferred to a mordant receiver sheet and washed as in Example 3. The transferred dye image showed absence or partial absence of magenta dye in the areas exposed to green and to white light, and of yellow dye in the areas exposed to blue and to white light, that is a positive image showing the desired color separation was obtained.

EXAMPLE 3

A developer dispersion was prepared by dissolving 0.6 g of the dioctylsulfosuccinate salt of 4-diethylamino-2-methylaniline in 0.6 ml of tritolylphosphate.

The resulting oily solution was mechanically dispersed in 10 ml of 6% gelatin solution (pH 4.0) to give an oil-in-water emulsion or dispersion having a droplet diameter of the order of 1 μm.

A dispersion of dye-bearing coupler 12 was prepared as in Example 1. A blue-sensitive silver dispersion of silver bromide and silver benzotriazole was prepared as in Example 1. The antifoggant solution used was as in Example 1.

The following coating composition was prepared, coated at 0.1 mm wet thickness (approximately 100 ml $m^{-2}$) on Estar TM polyester film base, and dried.

| | |
|---|---|
| dispersion of cyan dye-bearing coupler 12 | 1.0 ml |
| dispersion of developer | 1.0 ml |
| 6% gelatin solution | 1.0 ml |
| dimethyl urea | 0.02 g |
| propionamide | 0.02 g |
| water | 2.5 ml |
| antifoggant solution | 0.4 ml |

-continued

| | |
|---|---|
| blue-sensitive silver dispersion | 2.0 ml |

The light-sensitive dye donor sheet was tested in conjunction with a mordant receiver sheet which had the following structure:

Layer 3 titanium dioxide 8.9 $gm^{-2}$, ethyl cellulose 1.8 $gm^{-2}$, dimethylurea 1.8 $gm^{-2}$ Layer 2 gelatin 1.25 $gm^{-2}$, poly-4-vinylpyridine 1.0 $gm^{-2}$, dimethylurea 1.0 $gm^{-2}$ Layer 1 gelatin 2.5 $gm^{-2}$, $NiSO_4$, 0.085 $gm^{-2}$, dimethylurea 1.0 $gm^{-2}$ polyester film base The light-sensitive donor sheet was exposed to a sensitometric light source then laminated (dry) face-to-face with the receiver sheet, in contact with a curved metal block at 150° C. for 30 seconds, and the two sheets then stripped apart. Cyan dye was visible through the clear base of the receiver sheet, with a strong negative image in magenta dye superimposed on it. The unwanted magenta dye, which was not mordanted, was washed out with a methanol:water:cyclohexanone (65:25:10 by volume) mixture, to leave a clear positive image in mordanted metallized cyan dye, having Dmax 1.10, Dmin 0.54.

EXAMPLE 4

In this Example, the coupler moiety was a naphthol instead of a 5-pyrazolone, and the image dye was coated with the chromophoric hydroxyl substituted by a blocking group which is cleaved by reaction with excess developing agent during heat development, thus shifting the hue of the dye.

A dispersion of dye-bearing coupler was prepared by dissolving 0.25 g of Coupler 1 in a mixture of 0.25 ml of tritolyl phosphate and 2.5 ml of chloroform. This solution was mechanically dispersed into a solution of 7.0 ml of 6% gelatin solution containing 0.02 g of sodium dioctylsulfosuccinate surfactant, to give an oil-in-water emulsion or dispersion having dispersed droplets of mean diameter of the order of a μm.

A developer dispersion was prepared as in Example 1. The photographic emulsion used had silver bromide cubic grains of edge length 1.0 μm, was sulfur plus gold sensitized, and was 1M in silver bromide and had 50 g/l of gelatin. The silver benzotriazole dispersion was prepared by ball-milling, for more than 16 hours, 3.0 g of silver benzotriazole, 27 ml of water and 3 ml of 6% gelatin solution, and the irregular silver benzotriazole particles were of the order of 0.1 to 0.2 μm in size.

The coating was prepared by combining the following ingredients and coating the mixture at approximately 100 ml $m^{-2}$ as before:

| | |
|---|---|
| coupler dispersion | 1.0 ml |
| developer dispersion | 1.0 ml |
| propionamide | 0.03 g |
| 1-phenyl-2-tetrazoline-5-thione | 0.03 g |
| 5-methylbenzotriazole | 0.02 g |
| methanol | 0.2 ml |
| silver bromide emulsion | 2.0 ml |
| silver benzotriazole dispersion | 2.0 ml |

A portion of the dried coating was exposed to a sensitometric light source and developed by heating for 30 seconds on a curved metal block at 150° C. The resulting image was transferred to a receiving sheet of the type described in Example 1 by soaking the receiving sheet in a mixture of methanol and ethanolamine (3:1) and laminating the heat-developed donor sheet with the receiver sheet for 1 minute. A negative image in bluish dye was transferred to the receiving sheet but this was readily washed off to leave a clear positive image of the test object in pink dye on the receiving sheet. The transfer operation was repeated twice more on fresh pieces of mordant receiver sheet, and two more positive images were obtained. The heat developed donor sheet showed a retained negative image in pink dye which had been immobilized imagewise as explained above.

Another piece of the coating was loaded into a camera, and a picture taken of an outdoor scene. After processing and transferring as above, a positive transferred dye image of the scene was obtained, and a negative image in retained dye was left on the donor sheet.

EXAMPLE 5

A dispersion of silver benzotriazole was prepared by ball-milling (for 16 hours and using 5 mm glass balls or beads) the silver salt of benzotriazole, 3.0 g, in water, 27 ml, to which had been added molten 12½% w/v aqueous gelatin solution at pH 4.0, 3.0 ml.

To 10 ml of this dispersion was added 5 ml of a silver bromide photographic emulsion, having cubic grains of average edge length 0.48 μm, a gelatin content of approximately 50 g per liter of emulsion, and a silver content of 1 mole per liter. The emulsion was chemically sensitized with sulfur and gold at the rate of 2.5 mg of sodium thiosulfate pentahydrate and 1.9 mg of sodium aurichloride per mole of silver bromide.

To the combined dispersion was added 1.0 ml of an aqueous solution which contained 10% w/v tetramethylammonium p-toluenesulfonate, and 1% w/v Aerosol OT TM, and the resulting mixture was held for 10 minutes at 40° C.

A dispersion of developing agent was prepared by dissolving 0.6 g of the dioctylsulfosuccinate salt of 4-diethylamino-2-methylaniline in 0.6 ml of tritolylphosphate. The resulting oily solution was mechanically dispersed in 10 ml of 6% aqueous gelatin solution (pH 4.0) to give an oil-in-water emulsion or dispersion having a droplet diameter of the order of 1.0 μm.

A dispersion of Coupler 66 was prepared by dissolving 0.10 g of coupler in 1.0 ml of N-n-butylacetanilide and mechanically dispersing the resultant oily solution in 10 ml of 6% aqueous gelatin solution (pH 4.0) in which had been dissolved sodium lauryl sulfate, 0.02 g, and a 10% solution of surfactant Alkanol XC TM, 0.10 ml.

A coating was prepared under safelight conditions by combining together:

| | | |
|---|---|---|
| coupler dispersion | 1.0 ml | |
| developer dispersion | 0.5 ml | |
| 6% aqueous gelatin (pH 4.0) | 0.5 ml | |
| 10% aqueous n-butylurea solution | 0.3 ml | |
| water | 3.7 ml | |
| silver bromide/benzotriazole dispersion | 2.0 ml | |
| 5-methylbenzotriazole | 0.01 g | in 0.15 ml methanol |
| 1-phenyl-2-tetrazoline-5-thione | 0.02 g | |

The resulting mixture was coated at 0.1 mm wet thickness on polyethyleneterephthalate photographic film base and dried.

A portion of the coating was exposed through a step tablet to a sensitometric light source and was developed by contacting the back of the coating with a curved metal block maintained at 150° C. An image became visible within 1 second, background fog was observed at 4 seconds, and the strip was removed from the block at 5 seconds. On examining the strip under normal room light, a clear negative magenta colored image of the step tablet was observed, whose maximum density was 0.66 against a background of 0.44 (transmission densities using a green filter). In this and following Examples, photographic speeds or sensitivities were estimated by determining which step of the step tablet gave the faintest visible image. Speeds are quoted as—relative $\log_{10}$ (exposure), referred to an arbitrary value of 1.0 for the coating of the present Example. Thus a coating of relative speed 0.7 required $\log_{10}$ (exposure) 0.3 greater than the present Example, and a coating having a relative speed of 1.3 required 0.3 less.

EXAMPLE 6

This Example illustrates the use of a range of negative-working couplers of the invention. Coatings were prepared broadly as in Example 5, any significant change being noted in Table 2. Testing was as in Example 5. In all cases a negative magenta image was obtained. The processing temperature, time to first appearance of image, time to appearance of fog and total processing time are given in Table 2, as is the photographic speed as described in Example 5. Times are not given in those cases where it was difficult to assign a precise value.

TABLE 2

| Coupler | Coupler Solvent[a] | Process Temp °C. | Time(s) Image | Fog | Total | Speed |
|---|---|---|---|---|---|---|
| 18 | BA 1.0 | 150° C. | 1 | 4 | 7 | 0.7 |
| 16 | BA 1.0 + DMF 0.3 | " | 1 | 3 | 5 | 1.15 |
| 17 | BA 0.5 | " | 1 | 2 | 3 | 1.15 |
| 19 | BA 1.0 | " | | | 30 | 0.7 |
| 1 | BA 1.0 | " | | | 30 | 0.85 |
| 61 | BA 1.0 | " | | | 30 | 0.85 |
| 73 | TTP 0.4 + DMF 0.7 + CX 0.7 | " | 1 | | 30 | 1.0 |
| 71 | TTP 0.4 + DMF 0.7 + CX 0.7 | " | 2 | | 30 | 0.8 |
| 69 | None | " | 3 | | | |
| 27 | BA 1.0 | " | 1 | 4 | 5 | 1.3 |
| 62 | CL 0.4 | 140° C. | 2 | 22 | 25 | 0.85 |
| 63 | CL 0.4 + DMF 0.3 | 150° C. | 2 | | 30 | 1.15 |
| 72 | TTP 0.4, DMF 0.5 | " | 7 | 7 | 10 | 1.0 |
| 50 | BA 0.6 | 140° C. | 1 | | 15 | 1.3 |

Notes
a = Coupler solvents
BA = N—n-butylacetanilide,
TTP = tritolylphosphate
DMF = dimethylformamide,
CS = cyclohexanone
CL = cetyl alcohol. Number refers to ml of solvent used per 0.10 g of coupler.

Coupler No. 71

Developer was 0.5 ml of a solution of β-methane sulfonamidoethyl ethylamidotoluidine sesquisulfate, 1.76 g, in water, 40 ml, pH adjusted to 3.5 with sodium hydroxide.

Coupler 69

Solid coupler was dispersed by ball-milling.

Coupler No. 62

In place of n-butylurea, 0.05 g of p-toluamide as a ball-milled dispersion. Image was a bluish magenta.

EXAMPLE 7

This Example illustrates a preferred form of the invention, in which positive dye images are formed by a rapid, totally dry process.

Preparation of Light-Sensitive Material

A dispersion of Coupler No. 54 was prepared by ball-milling for 18 hours, using 5 mm diameter glass balls, 0.30 g of dye-coupler 54 in 30 ml of 0.6% w/v gelatin solution (pH 4.0) to which had been added 0.9 ml of a 10% w/v solution of sodium triisopropyl naphthalene sulfonate.

A dispersion of thermal solvent was prepared by mechanically dispersing, with a high shear emulsifying device, a molten mixture of 0.50 g of monostearin and 0.50 g of cetyl alcohol, into 9 ml of water containing 0.02 g of sodium dodecyl sulfate.

A spectrally sensitized silver dispersion was prepared by adding 0.7 ml of a 0.1% w/v solution, in 2:3 dimethylformamide:methanol, of Sensitizing Dye I, to 10 ml of silver bromide photographic emulsion similar to that described in Example 5. After 10 minutes at 40° C. the dyed emulsion was added to 10 ml of silver benzotriazole dispersion prepared as in Example 5. The dispersions were thoroughly mixed and the combined silver dispersion allowed to stand for 10 minutes before use.

A coating mixture was prepared under safelight conditions by combining together 1.5 ml of dye-coupler dispersion, 2.0 ml of silver dispersion, 1.0 ml of thermal solvent dispersion, 0.7 ml of developer dispersion prepared as in Example 5, 2.3 ml of water containing 0.03 g of butylurea, and 0.02 g of 1-phenyl-2,2-tetrazolinethione dissolved in 0.15 ml of methanol. The mixture was coated at 0.1 mm wet thickness of polyethylene terephthalate film base and dried.

(Sensitizing Dye I was anhydro-5,5',6,6'-tetrachloro-1,1',3-triethyl-3'-(sulfobutyl)benzimidazolocarbocyanine hydroxide.)

Preparation of Image Receiving Sheet

A separate image receiving sheet was prepared by coating Solution A at 0.1 mm wet thickness on polyethylene terephthalate photographic film base and, then dry, supercoating it at 0.1 mm wet thickness with Suspension B.

| | |
|---|---|
| Solution A | |
| poly-4-vinyl pyridine | 2.9 g |
| ethanol | 43. ml |
| water | 21. ml |
| The above was dissolved, then was added in order: | |
| 12½% w/v gelatin solution | 29. ml |
| ammonia solution, s.g. 0.88 | 7.0 ml |
| nicotinamide | 4.0 g |
| sym-dimethylurea | 4.0 g |
| nickel sulfate | 0.43 g |
| Triton X-100 TM | 0.2 g |
| Suspension B | |
| titanium dioxide | 9.0 g |
| ethyl cellulose | 3.0 g |
| cetyl alcohol | 4.0 g |
| butanone | 60. ml |

-continued

The above was ball-milled to give a smooth white suspension.

Formation of Image

A portion of the light-sensitive material was exposed to a sensitometric test object and developed by contacting the back of the coating for 15 seconds against a curved metal block maintained at 150° C. The developed material was then contacted face-to-face with a piece of image receiving sheet and the two laminated together in intimate contact for 15 seconds against a curved metal block maintained at 130° C. The two sheets were then separated to reveal a negative magenta image on the light-sensitive material, and a clear positive cyan image in the image receiving sheet, having a maximum (background) density of 1.30 (by reflection, red filter) and a minimum (image) density of 0.46.

A further sample of light-sensitive material was exposed in a camera to an outdoor scene at an ASA speed rating of 7.5. On processing as above a clear positive cyan picture of the scene was formed in the receiving sheet.

EXAMPLE 8

A coating was made exactly as in Example 7 except the dye-coupler used was Coupler 45, and no spectral sensitizer was added to the silver bromide emulsion.

After exposing to a sensitometric test-object and developing and transferring the image as in Example 7, a positive cyan image of maximum density 1.15 and minimum density 0.63 was observed in the receiving sheet.

EXAMPLE 9

A coating was made as in Example 8 except that Coupler 55 was used, and was ball-milled in the presence of an equal weight of N-methyl-N-octyl formamide. In addition, 0.04 g of dibutylurea and 0.5 ml chloroform were added to the final coating mixture.

After testing as in Example 8, a positive yellow image was observed in the receiving sheet, having a maximum density of 0.68 and a minimum density of 0.32 (measured by reflection through a blue filter).

EXAMPLE 10

Preparation of Light-Sensitive Material

A dispersion of Coupler 44 was prepared by dissolving 0.10 g of coupler in 0.86 ml of N-n-butyl acetanilide together with 0.40 ml of dimethyl formamide, and mechanically dispersing the resultant solution into an aqueous solution consisting of 6.7 ml of 6.3% w/v gelatin containing 0.01 g of sodium dodecyl sulfate.

Dispersions of thermal solvent, and of silver bromide photographic emulsion with silver benzotriazole, were prepared as in Example 7.

A coating mixture was prepared under safelight conditions by combining together 1.0 ml of dye-coupler dispersions, 2.0 ml of silver dispersion, 0.5 ml of developer dispersion prepared as in Example 5, 1.0 ml of thermal solvent dispersion, 3.0 ml of water containing 0.05 g n-butylurea plus 0.06 g of malonic acid, and 0.02 g of 1-phenyl-2-tetrazoline-5-thione dissolved in 0.15 ml of methanol. The mixture was coated at 0.1 mm wet thickness on polyethylene terephthalate film base and dried.

Image Receiving Sheet

A three-layer receiving sheet having the following structure was used:

Layer 3 titanium dioxide 8.9 $gm^{-2}$, ethyl cellulose 1.8 $gm^{-2}$, dimethylurea 1.8 $gm^{-2}$ Layer 2 gelatin 1.25 $gm^{-2}$, poly-4-vinylpyridine 1.0 $gm^{-2}$, dimethylurea 1.0 $gm^{-2}$ Layer 1 gelatin 2.5 $gm^{-2}$, $NiSO_4$, 0.085 $gm^{-2}$, dimethylurea 1.0 $gm^{-2}$ polyester film base Formation of Image A portion of the light-sensitive material was exposed to a sensitometric test object and developed by contacting the back of the coating for 5 seconds against a curved metal block maintained at 140° C. The developed material was then contacted face-to-face with a piece of image receiving sheet and the two laminated together in intimate contact for 30 seconds against the curved metal block at 140° C. On separating the two sheets, a negative magenta image was observed on the donor material, and a clear positive cyan image, was observed on the receiving sheet.

A further portion of the light-sensitive material was exposed and developed as above for 10 seconds at 140° C. The dye image was then transferred to a mordant receiver sheet (containing the mordant copoly(-styrene(N-vinylbenzyl-N-benzyl-N,N-dimethyl)ammonium chloride), dispersed in gelatin and coated on polyethylene coated paper) by laminating the donor material to the receiver sheet which has been wetted with a mixture of methanol:cyclohexanone:water 75:25:10. The layers were left in face-to-face contact for two minutes then peeled apart, to reveal a magenta on pink negative image in the donor material and a white on pink positive image in the receiver sheet. The receiver sheet was dipped briefly in dilute aqueous sodium carbonate solution to ionize and mordant the image dye, which resulted in a strong white on blue positive image.

EXAMPLE 11

This Example illustrates the use of a non-dye-bearing coupler in a positive-working monochrome image transfer system.

Light Sensitive Material

A dispersion of Coupler 27 was made by dissolving 0.10 g of the coupler in 1.0 ml of N-n-butylacetanilide, and mechanically dispersing the resultant oily solution into 10 ml of 6.3% w/v aqueous gelatin solution in which was dissolved 0.01 g of sodium dodecyl sufate and 0.01 g of triisopropyl naphthalene sulfonate.

A coating mixture was prepared under safelight conditions by combining together 1.0 ml of coupler dispersion as above, 2.0 ml of silver dispersion and 0.5 ml of developer dispersion both as described in Example 2, 1.0 ml of thermal solvent dispersion as described in Example 7, 3.9 ml of water in which was dissolved 0.02 g of butylurea plus 0.04 g of malonic acid, and 0.02 g of 1-phenyl-2-tetrazoline-5-thione dissolved in 0.15 ml of methanol. The mixture was coated at 0.1 mm wet thickness of polyethylene terephthalate film base and dried.

Image Receiving Sheet

A dispersion of silver stearate was prepared by ball-milling for 18 hours a mixture of 3.0 g of silver stearate, 0.3 g of polyvinyl butyral, and 30 ml of dichloromethane in which was dissolved 0.5 g of ethyl cellulose, 0.1 g of stearic acid and 0.1 g of sym-dibutylurea. The resultant dispersion was coated onto paper at 0.1 mm wet thickness to give a non-light-sensitive receiving layer.

Formation of Image

A portion of the light-sensitive material was exposed to a sensitometric test object and preheated for 10 seconds at 100° C. It was then laminated face-to-face with a piece of receiving sheet and the laminate held for 10 seconds against a curved metal block maintained at 140° C. The two sheets were separated to reveal a clear white on grey positive image of the test object on the receiving sheet.

The invention has been described in detail with particular reference to preferred embodiments thereof, but it will be understood that variations and modifications can be effected within the spirit and scope of the invention.

What is claimed is:

1. In dye-forming photothermographic element comprising a support bearing, in a binder, in reactive association,
   (a) photographic silver halide,
   (b) an image forming combination comprising
      (i) a reducible organic silver salt and
      (ii) a reducing agent selected from the group consisting of p-phenylenediamine, p-aminophenol, sulfonamidophenol, sulfonamidoaniline and hydrazone developing agents, and
   (c) a coupler which is capable of reacting with the oxidized form of said reducing agent to form a dye, the improvement wherein
   said coupler has attached to a carbon atom at the coupling position a moiety —S—Z—, wherein —Z— represents atoms linking the sulfur atom to another position in the coupler.

2. A dye-forming photothermographic element as in claim 1 wherein said coupler is a compound represented by the formula:

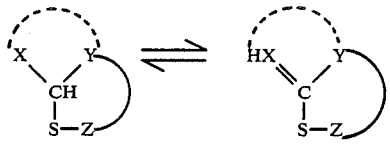

wherein:
   X and Y are moieties which confer coupling activity on the carbon atom shown in the formula;
   the broken line between X and Y represents linking atoms or a separation of X and Y; and
   Z represents atoms necessary to link Z and Y.

3. A dye-forming photothermographic element as in claim 1 wherein said coupler is a compound represented by the formula:

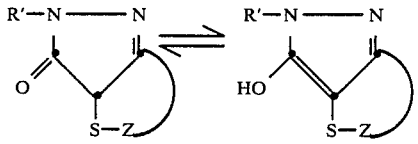

wherein:
   R' is hydrogen or a substituent group which does not adversely affect coupling action of said coupler; and
   Z represents atoms necessary to link Z to the pyrazolone ring.

4. A dye-forming photothermographic element as in claim 1 wherein said coupler is a compound represented by the formula:

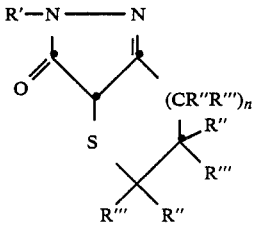

wherein:
   n is 0, 1 or 2;
   R', R'' and R''' are individually hydrogen; a substituent which does not adversely affect coupling action of said coupler; or any or R'' and R''' together complete a ring.

5. A dye-forming photothermographic element as in claim 1 wherein said coupler is a compound represented by the formula:

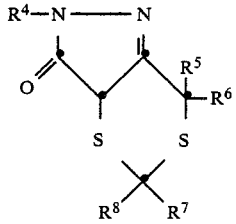

wherein:
   $R^4$ is hydrogen or an unsubstituted or substituted alkyl, cycloalkyl, aryl or heterocyclic group;
   $R^5$, $R^6$, $R^7$ and $R^8$ are individually hydrogen or an unsubstituted or substituted alkyl or aryl group; or
   $R^5$ and $R^6$ together or $R^7$ and $R^8$ together represent the atoms necessary to complete a ring.

6. A dye-forming photothermographic element as in claim 1 wherein said coupler is a compound represented by the formula:

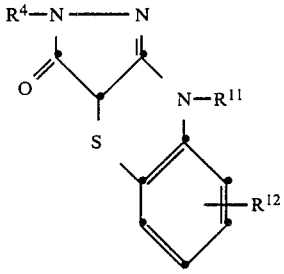

wherein:
   $R^4$ is hydrogen or an unsubstituted or substituted alkyl, cycloalkyl, aryl or heterocyclic group;
   $R^{11}$ is hydrogen, unsubstituted or substituted alkyl, or acyl group; and $R^{12}$ is hydrogen or a substituent group which does not adversely affect coupling action of said coupler.

7. A dye-forming photothermographic element as in claim 1 wherein said coupler is a compound represented by the formula:

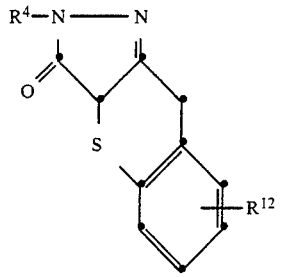

wherein:

$R^4$ is hydrogen or an unsubstituted or substituted alkyl, cycloalkyl, aryl or heterocyclic group; and $R^{12}$ is hydrogen or a substituent group which does not adversely affect coupling action of said coupler.

8. A dye-forming photothermographic element as in claim 1 wherein said coupler is:

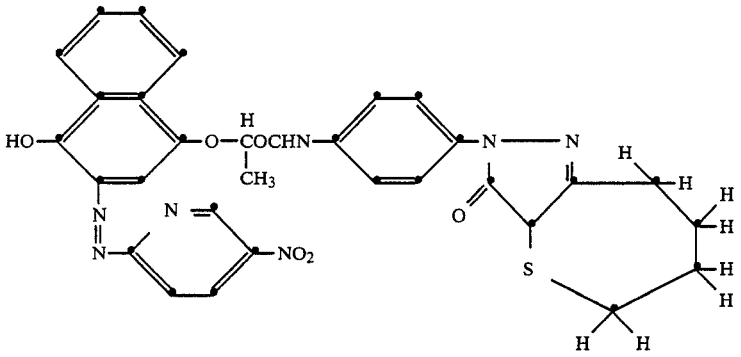

or

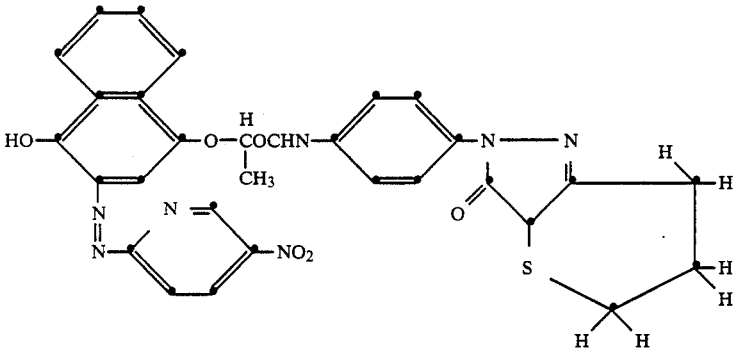

9. A dye-forming photothermographic element as in claim 1 wherein said binder is hydrophilic and said photographic silver halide is a gelatino silver halide photographic emulsion.

10. A dye-forming photothermographic element as in claim 1 comprising an image receiving layer separated from the remaining components of said element by an opaque white layer.

11. In a dye-forming, integral diffusion transfer photothermographic element comprising, in sequence, (A) a transparent support bearing (B) a dye mordant layer, (C) an opacifying layer and (D) at least one photothermographic layer comprising in a binder, (a) photographic silver halide, (b) an image forming combination comprising (i) a reducible organic silver salt and (ii) a reducing agent selected from the group consisting of p-phenylenediamine, p-aminophenol, sulfonamidophenol, sulfonamidoaniline and hydrazone developing agents, and (c) a coupler which is capable of reacting with the oxidized form of said reducing agent to form a dye, the improvement wherein said coupler has attached to a carbon atom at the coupling position a moiety —S—Z—, wherein —Z— represents atoms linking the sulfur atom to another position in the coupler.

12. A method of forming a dye image in an exposed photothermographic element as defined in claim 1 comprising heating said element to a temperature within the range of about 80° C. to about 200° C. until said dye image is formed.

13. A method of forming a dye image in an exposed photothermographic element as defined in claim 1 comprising heating said element to a temperature within the range of about 80° C. to about 200° C. until said dye image is formed and then transferring the resulting dye image to an image receiving layer.

14. A method of forming a dye image in an exposed, dye-forming, integral diffusion transfer photothermographic element as defined in claim 11 comprising heating said element to a temperature within the range of about 80° C. to about 200° C. until said dye image is formed and then transferring the resulting dye image to said dye mordant layer.

* * * * *